US011009300B2

(12) United States Patent
Matsumoto et al.

(10) Patent No.: US 11,009,300 B2
(45) Date of Patent: May 18, 2021

(54) HEAT EXCHANGER AND AIR-CONDITIONING APPARATUS

(71) Applicant: Mitsubishi Electric Corporation, Chiyoda-ku (JP)

(72) Inventors: Takashi Matsumoto, Chiyoda-ku (JP); Takamasa Uemura, Chiyoda-ku (JP); Shigeyoshi Matsui, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 56 days.

(21) Appl. No.: 16/468,988

(22) PCT Filed: Jul. 5, 2017

(86) PCT No.: PCT/JP2017/024654
§ 371 (c)(1),
(2) Date: Jun. 12, 2019

(87) PCT Pub. No.: WO2018/154806
PCT Pub. Date: Aug. 30, 2018

(65) Prior Publication Data

US 2020/0103148 A1 Apr. 2, 2020

(30) Foreign Application Priority Data

Feb. 21, 2017 (JP) ..... JP2017-030208

(51) Int. Cl.
*F28F 1/12* (2006.01)
*F25B 39/00* (2006.01)
(Continued)

(52) U.S. Cl.
CPC ..... *F28F 1/128* (2013.01); *F25B 39/00* (2013.01); *F28D 1/0233* (2013.01);
(Continued)

(58) Field of Classification Search
CPC .. F25B 47/025; F28D 1/0233; F28D 1/05325; F28F 1/022; F28F 1/04;
(Continued)

(56) References Cited

U.S. PATENT DOCUMENTS 5,033,540 A * 7/1991 Tategami ..... F28D 1/0435 165/135
5,992,514 A * 11/1999 Sugimoto ..... F28D 1/0435 165/135
(Continued)

FOREIGN PATENT DOCUMENTS

JP 58-214793 A 12/1983
JP 3-177795 A 8/1991
(Continued)

OTHER PUBLICATIONS

International Search Report dated Sep. 26, 2017 in PCT/JP2017/024654 filed Jul. 5, 2017.

*Primary Examiner* — Devon Russell
(74) *Attorney, Agent, or Firm* — Xsensus LLP

(57) ABSTRACT

A heat exchanger includes flat cross-sectional shaped heat transfer tubes arranged with gaps between flat surfaces of the flat heat transfer tubes facing each other, and each having a flow passage in a vertical direction, and corrugated fins disposed between the flat surfaces facing each other. The corrugated fins each include an end portion in a direction in which air flows, and protruding from end portions of the flat surfaces, a drain hole provided adjacent to central regions of the flat surfaces in the direction in which the air flows, first louvers located upstream of the drain hole, and each including a slit and a slat that is inclined in the vertical direction, and second louvers located downstream of the drain hole, and each including a slit and a slat that is inclined in the vertical direction.

8 Claims, 22 Drawing Sheets

(51) Int. Cl.

| | |
|---|---|
| ***F28D 1/02*** | (2006.01) |
| ***F28D 1/053*** | (2006.01) |
| ***F28F 1/02*** | (2006.01) |
| ***F28F 1/04*** | (2006.01) |
| ***F28F 1/14*** | (2006.01) |
| ***F28F 1/24*** | (2006.01) |
| ***F28F 17/00*** | (2006.01) |
| ***F28F 1/32*** | (2006.01) |
| *F24F 1/0067* | (2019.01) |
| *F24F 1/18* | (2011.01) |

(52) U.S. Cl.
CPC ..... *F28D 1/05325* (2013.01); *F28F 1/022* (2013.01); *F28F 1/04* (2013.01); *F28F 1/14* (2013.01); *F28F 1/24* (2013.01); *F28F 1/325* (2013.01); *F28F 17/005* (2013.01); *F24F 1/0067* (2019.02); *F24F 1/18* (2013.01)

(58) Field of Classification Search
CPC .... F28F 1/14; F28F 1/128; F28F 1/325; F28F 17/00; F28F 17/005
See application file for complete search history.

(56) References Cited

U.S. PATENT DOCUMENTS

| | | | | |
|---|---|---|---|---|
| 6,889,757 | B2 * | 5/2005 | Iwasaki | F28D 1/0435 165/135 |
| 9,534,827 | B2 * | 1/2017 | Sato | F28F 1/128 |
| 2006/0237173 | A1 | 10/2006 | Okura et al. | |
| 2007/0084589 | A1 | 4/2007 | Nishino et al. | |
| 2007/0199686 | A1 * | 8/2007 | Okinotani | F28F 19/00 165/152 |
| 2009/0133860 | A1 | 5/2009 | Harada et al. | |
| 2009/0301696 | A1 * | 12/2009 | Iwasaki | F28F 13/06 165/140 |
| 2010/0006276 | A1 * | 1/2010 | Cremaschi | F28F 1/022 165/175 |
| 2017/0082381 | A1 * | 3/2017 | Sugimura | F28D 1/053 |
| 2018/0100659 | A1 | 4/2018 | Yoshimura et al. | |

FOREIGN PATENT DOCUMENTS

| | | | | | |
|---|---|---|---|---|---|
| JP | 6-147785 | A | | 5/1994 | |
| JP | 6-221787 | A | | 8/1994 | |
| JP | 10-231724 | A | | 9/1998 | |
| JP | 11-147148 | A | | 6/1999 | |
| JP | 2004-177040 | A | | 6/2004 | |
| JP | 2005201492 | A | * | 7/2005 | F28D 1/05383 |
| JP | 2006-292336 | A | | 10/2006 | |
| JP | 2007-113802 | A | | 5/2007 | |
| JP | 2009-127937 | A | | 6/2009 | |
| JP | 2012233680 | A | * | 11/2012 | F28F 1/325 |
| JP | 2013139042 | A | * | 7/2013 | F28F 1/128 |
| JP | 2015-183908 | A | | 10/2015 | |
| JP | 2016-125748 | A | | 7/2016 | |
| WO | WO 2016/158193 | A1 | | 10/2016 | |

* cited by examiner

HEAT EXCHANGER AND AIR-CONDITIONING APPARATUS

TECHNICAL FIELD

The present invention relates to a heat exchanger including corrugated fins and an air-conditioning apparatus.

BACKGROUND ART

An example of a heat exchanger in the related art includes a plurality of flat heat transfer tubes arranged in a direction orthogonal to the direction of airflow, corrugated fins disposed between the flat heat transfer tubes and inclined upward in a depth direction, and a plurality of louvers provided on each corrugated fin and oriented horizontally to the corrugated fin (see, for example, Patent Literature 1).

CITATION LIST

Patent Literature

Patent Literature 1: Japanese Unexamined Patent Application Publication No. 2004-177040

SUMMARY OF INVENTION

Technical Problem

As the corrugated fins described in Patent Literature 1 are provided with the louvers oriented horizontally to the corrugated fins, condensed water accumulates on the louvers. As the condensed water accumulates, the resistance applied to air that flows through the louvers increases. Also, the accumulated water may freeze during a low-temperature operation. As a result, the heat exchange efficiency is reduced.

The present invention has been made to solve the above-described problems, and an object of the present invention is to provide a heat exchanger and an air-conditioning apparatus in which accumulation of condensed water on the corrugated fins is reduced and the heat exchange efficiency is increased.

Solution to Problem

A heat exchanger according to an embodiment of the present invention includes a plurality of flat heat transfer tubes each having a flat shape in cross section, the plurality of flat heat transfer tubes being arranged with gaps between flat surfaces of the plurality of flat heat transfer tubes facing each other, the plurality of flat heat transfer tubes each having a flow passage extending through a corresponding one of the plurality of flat heat transfer tubes in a vertical direction, and a plurality of corrugated fins each bent in a zigzag shape in the vertical direction and disposed between the flat surfaces facing each other. The plurality of corrugated fins each have an end portion at an upstream end in a direction in which air flows to pass through the plurality of corrugated fins, the end portion protruding from end portions of the flat surfaces of the plurality of flat heat transfer tubes, a drain hole provided adjacent to central regions of the flat surfaces of the plurality of flat heat transfer tubes in the direction in which the air flows, a plurality of first louvers located upstream of the drain hole in the direction in which the air flows, the plurality of first louvers each including a slit and a slat that is inclined in the vertical direction and that causes the air to flow through the slit, and a plurality of second louvers located downstream of the drain hole in the direction in which the air flows, the plurality of second louvers each including a slit and a slat that is inclined in the vertical direction and that causes the air to flow through the slit.

Advantageous Effects of Invention

According to an embodiment of the present invention, each corrugated fin includes the drain hole at the location adjacent to the central regions of the flat surfaces of the flat heat transfer tubes, and also includes the first louvers that are located upstream of the drain hole and the second louvers that are located downstream of the drain hole in the direction in which the air flows. With this configuration, drainage of water from the corrugated fins during a heating operation can be improved, and the amount of residual water can be reduced. As a result, water does not easily freeze on the corrugated fins, and heat exchange efficiency can be increased.

DESCRIPTION OF EMBODIMENTS

Heat exchangers and air-conditioning apparatuses according to embodiments of the present invention will be described below with reference to the drawings. The same or corresponding elements are denoted by the same reference signs in each drawing, and description of the elements is omitted or simplified as appropriate. The shapes, sizes, arrangements, and other features of the structures illustrated in each drawing may be changed as appropriate within the scope of the present invention.

Embodiment 1

Figure 1:
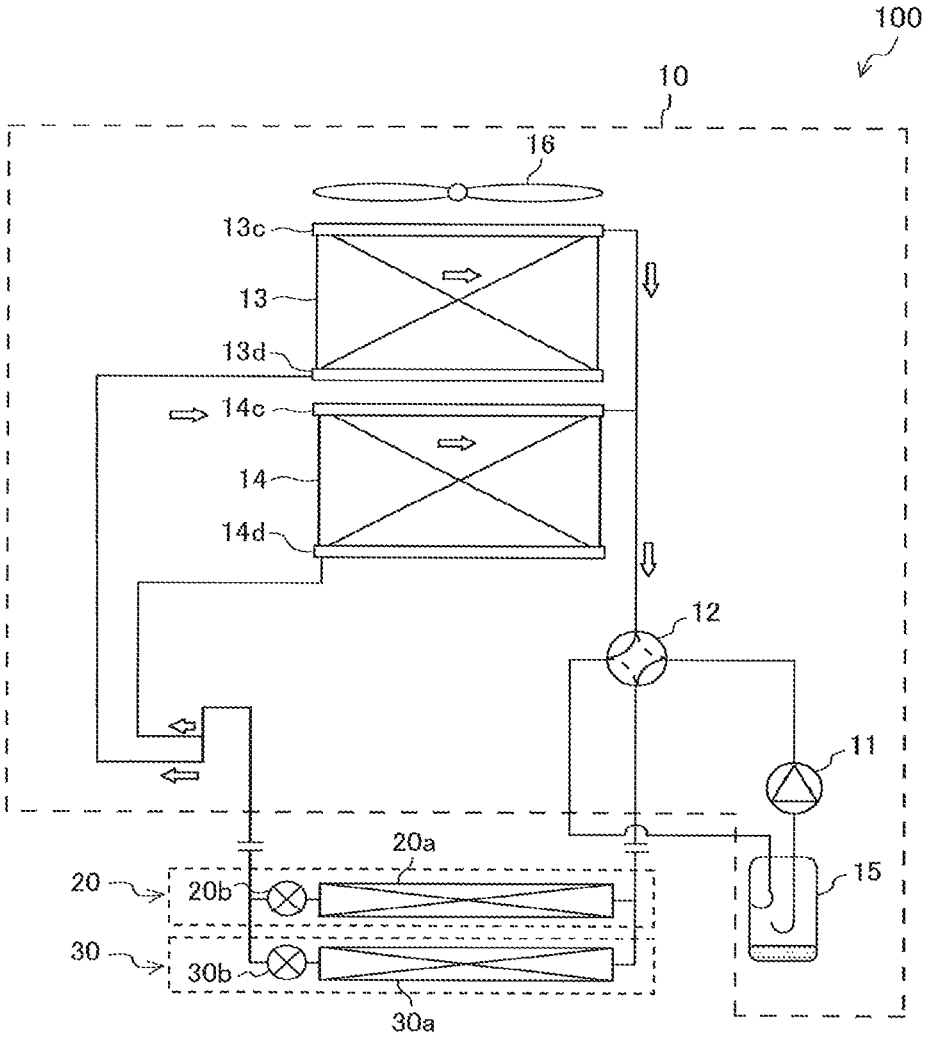
FIG. 1 is a refrigerant circuit diagram illustrating the overall structure of an air-conditioning apparatus according to Embodiment 1 of the present invention.
Figure 2:
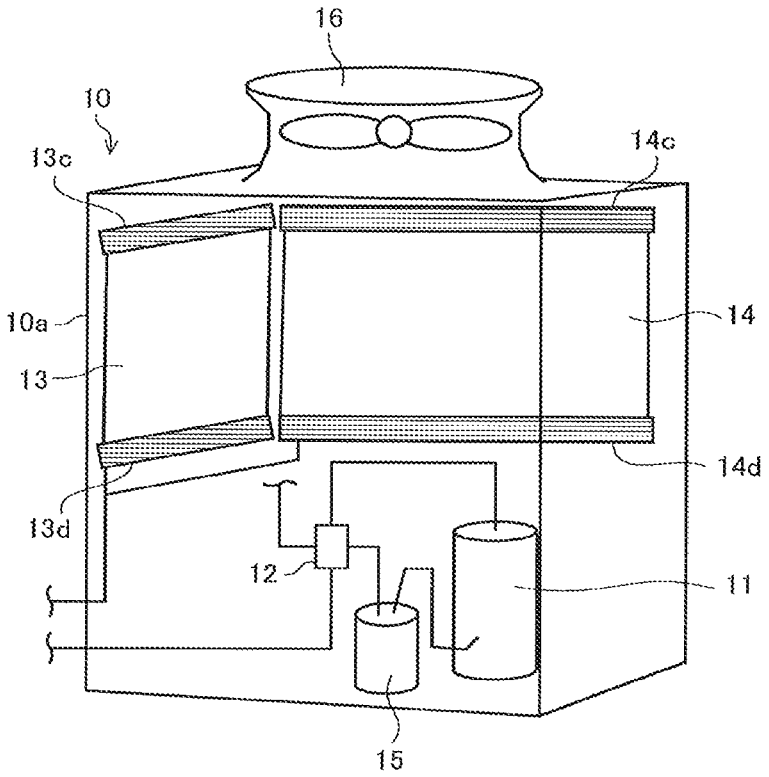
FIG. 2 is a schematic see-through perspective view of a heat source-side unit illustrated in FIG. 1.

FIG. 1 is a refrigerant circuit diagram illustrating the overall structure of an air-conditioning apparatus according to Embodiment 1 of the present invention. FIG. 2 is a schematic see-through perspective view of a heat source-side unit illustrated in FIG. 1.

An air-conditioning apparatus 100 according to Embodiment 1 is, for example, a variable refrigerant flow system including a heat source-side unit 10, a use-side unit 20 connected to the heat source-side unit 10, and another use-side unit 30 connected in parallel to the use-side unit 20. The heat source-side unit 10 is disposed outdoors, and the use-side units 20 and 30 are disposed indoors in spaces to be air conditioned. Although two use-side units 20 and 30 are connected to the heat source-side unit 10 in Embodiment 1, the number of use-side units 20 and 30 is not limited.

The heat source-side unit 10 includes a compressor 11, a flow switching device 12, heat source-side heat exchangers (each corresponding to a heat exchanger according to the present invention) 13 and 14, an accumulator 15, and a fan 16. The use-side unit 20 includes a use-side heat exchanger 20*a*, an expansion device 20*b*, and a fan (not shown). Similar to the use-side unit 20, the use-side unit 30 includes a use-side heat exchanger 30*a*, an expansion device 30*b*, and a fan. The compressor 11, the flow switching device 12, the heat source-side heat exchangers 13 and 14, the accumulator 15, the use-side heat exchangers 20*a* and 30*a*, and the expansion devices 20*b* and 30*b* are connected to each other by refrigerant pipes to enable refrigerant to circulate to selectively perform a cooling operation and a heating operation.

The compressor 11 sucks in low-temperature low-pressure refrigerant and compresses the refrigerant into a high-temperature high-pressure state. The compressor 11 is, for example, a scroll compressor, a reciprocating compressor, or a vane compressor. The flow switching device 12 switches a flow passage to a heating-operation flow passage or a cooling-operation flow passage depending on whether the operation mode is to be a cooling operation or a heating operation. The flow switching device 12 is, for example, a four-way valve.

The flow switching device 12 connects a discharge port of the compressor 11 to the use-side heat exchangers 20*a* and 30*a* and connects a suction port of the compressor 11 to the heat source-side heat exchangers 13 and 14 with the accumulator 15 provided between the compressor 11 and the heat source-side heat exchangers 13 and 14 during the heating operation. The flow switching device 12 connects the discharge port of the compressor 11 to the heat source-side heat exchangers 13 and 14 and connects the suction port of the compressor 11 to the use-side heat exchangers 20*a* and 30*a* with the accumulator 15 provided between the compressor 11 and the use-side heat exchangers 20*a* and 30*a* during the cooling operation. Although the flow switching device 12 is a four-way valve in this example, the flow switching device 12 is not limited to this example, and may instead be a combination of a plurality of two-way valves.

As illustrated in FIG. 2, the heat source-side heat exchangers 13 and 14 are arranged in an L-shape along one side surface and a back surface of a housing 10*a* of the heat source-side unit 10 in an upper region of the housing 10*a*. The heat source-side heat exchangers 13 and 14, whose structure will be described in detail below, include flat heat transfer tubes, corrugated fins disposed between the flat heat transfer tubes, upper headers 13*c* and 14*c* attached to the top ends of the flat heat transfer tubes, and lower headers 13*d* and 14*d* attached to the bottom ends of the flat heat transfer tubes. The upper headers 13*c* and 14*c* are connected to the flow switching device 12, and the lower headers 13*d* and 14*d* are connected to the use-side unit 20.

The accumulator 15, which is connected to the suction port of the compressor 11, separates refrigerant that flows into the accumulator 15 from the flow switching device 12 into gas refrigerant and liquid refrigerant. Among the gas refrigerant and the liquid refrigerant separated from each other by the accumulator 15, the gas refrigerant is sucked into the compressor 11. The fan 16, which is disposed in the upper region of the housing 10*a* of the heat source-side unit 10, sucks outside air through the heat source-side heat exchangers 13 and 14 and discharges the air upward.

The expansion devices 20*b* and 30*b* are disposed between the use-side heat exchangers 20*a* and 30*a* and the heat source-side heat exchangers 13 and 14, and are, for example, linear electronic expansion valves (LEV) capable of adjusting the flow rate of the refrigerant. The expansion devices 20*b* and 30*b* adjust the pressure and temperature of the refrigerant. The expansion devices 20*b* and 30*b* may instead be, for example, on-off valves that open and close to enable and disable the flow of the refrigerant.

The heating operation of the air-conditioning apparatus having the above-described structure will be described below with reference to FIG. 1.

The gas refrigerant separated by the accumulator 15 is sucked into the compressor 11 and compressed into high-temperature high-pressure gas refrigerant. The high-temperature high-pressure gas refrigerant is discharged from the compressor 11 and flows through the flow switching device 12 and into the use-side heat exchangers 20*a* and 30*a*. The high-temperature high-pressure gas refrigerant that has flowed into the use-side heat exchangers 20*a* and 30*a* exchanges heat with indoor air supplied by the fans included in the use-side units 20 and 30, thereby rejecting heat and being condensed into low-temperature high-pressure liquid refrigerant, which flows out of the use-side heat exchangers 20*a* and 30*a*. The low-temperature high-pressure liquid refrigerant that has flowed out of the use-side heat exchangers 20*a* and 30*a* is expanded and reduced in pressure by the expansion devices 20*b* and 30*b* to change into low-temperature low-pressure two-phase gas-liquid refrigerant, which flows out of the use-side units 20 and 30.

The low-temperature low-pressure two-phase gas-liquid refrigerant that has flowed out of the use-side units 20 and 30 flows into the heat source-side heat exchangers 13 and 14 through the lower headers 13*d* and 14*d*. The low-temperature low-pressure two-phase gas-liquid refrigerant that has flowed into the heat source-side heat exchangers 13 and 14 exchanges heat with outside air supplied by the fan 16, thereby absorbing heat and being evaporated into low-pressure gas refrigerant, which flows out from the upper headers 13*c* and 14*c*. The gas refrigerant flows through the flow switching device 12 and into the accumulator 15. The low-pressure gas refrigerant that has flowed into the accumulator 15 is separated into liquid refrigerant and gas refrigerant, and low-temperature low-pressure gas refrigerant is sucked into the compressor 11 again. The gas refrigerant sucked into the compressor 11 is discharged after being compressed by the compressor 11 again. Thus, the refrigerant is continuously circulated.

Figure 3:
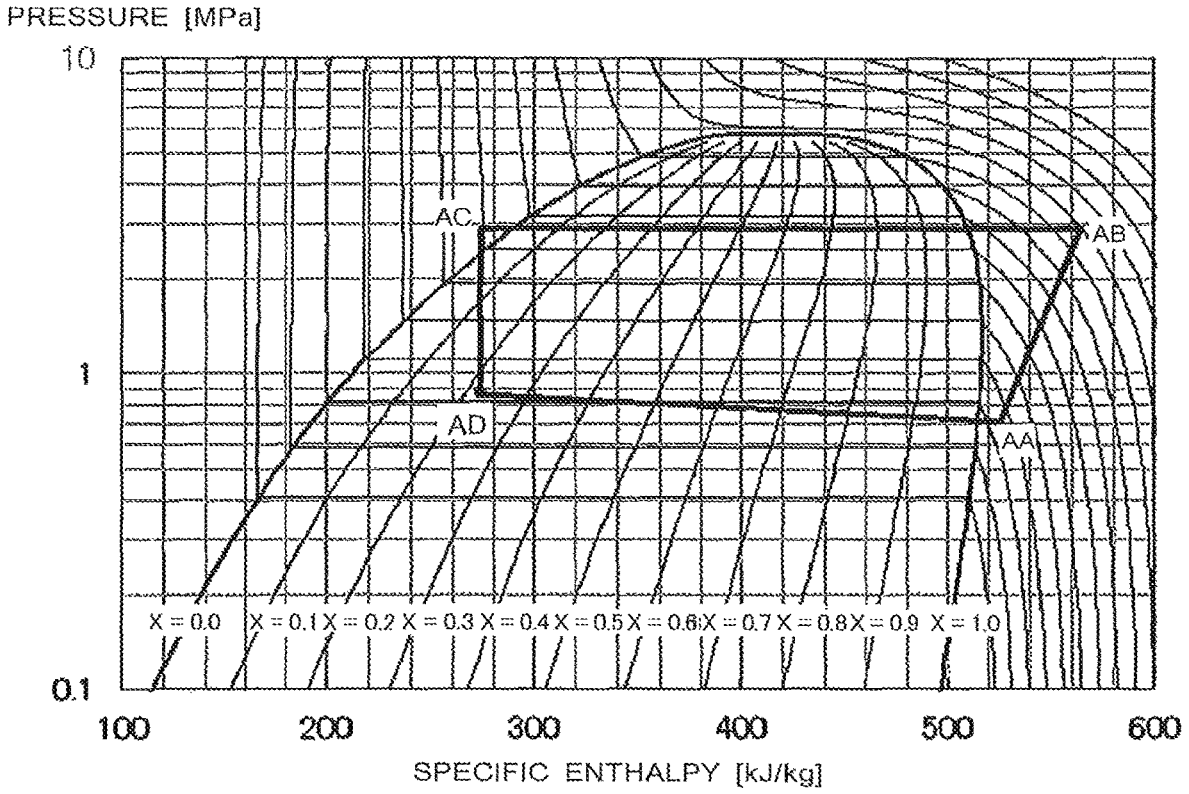
FIG. 3 is a P-H diagram of a refrigeration cycle when hydrofluorocarbon refrigerant R410*a* is used in the air-conditioning apparatus illustrated in FIG. 1.

FIG. 3 is a P-H diagram of a refrigeration cycle when hydrofluorocarbon refrigerant R410*a* is used in the air-conditioning apparatus illustrated in FIG. 1.

The operation in which the heat source-side heat exchangers 13 and 14 serve as evaporators (heating operation) will be described with reference to FIG. 3. In FIG. 3, the substantially trapezoidal solid line represents the state of operation of the refrigeration cycle. The lines X=0.1 to X=0.9 extending from the horizontal axis, which represents enthalpy, are constant quality lines representing respective gas ratios of the refrigerant. The upwardly convex solid curve is the saturation curve. The refrigerant is in gas phase in the region to the right of the saturation curve, and is in liquid phase in the region to the left of the saturation curve.

In the above-described heating operation, the refrigeration cycle operates from point AB to point AC, point AD, and point AA. The refrigerant at point AB is the high-temperature high-pressure gas refrigerant discharged from the compressor 11. This gas refrigerant rejects heat in the use-side heat exchangers 20*a* and 30*a* and changes into low-temperature high-pressure liquid refrigerant at point AC at the outlets of the use-side heat exchangers 20*a* and 30*a*. The low-temperature high-pressure liquid refrigerant flows through the expansion devices 20*b* and 30*b*, thereby being reduced in pressure and becoming low-temperature low-pressure two-phase gas-liquid refrigerant at a quality of about 0.23 at point AD. The two-phase gas-liquid refrigerant flows into the heat source-side heat exchangers 13 and 14 and absorbs heat, thereby being evaporated into low-pressure gas refrigerant at point AA, which is sucked into the compressor 11 through the accumulator 15.

Figure 4:
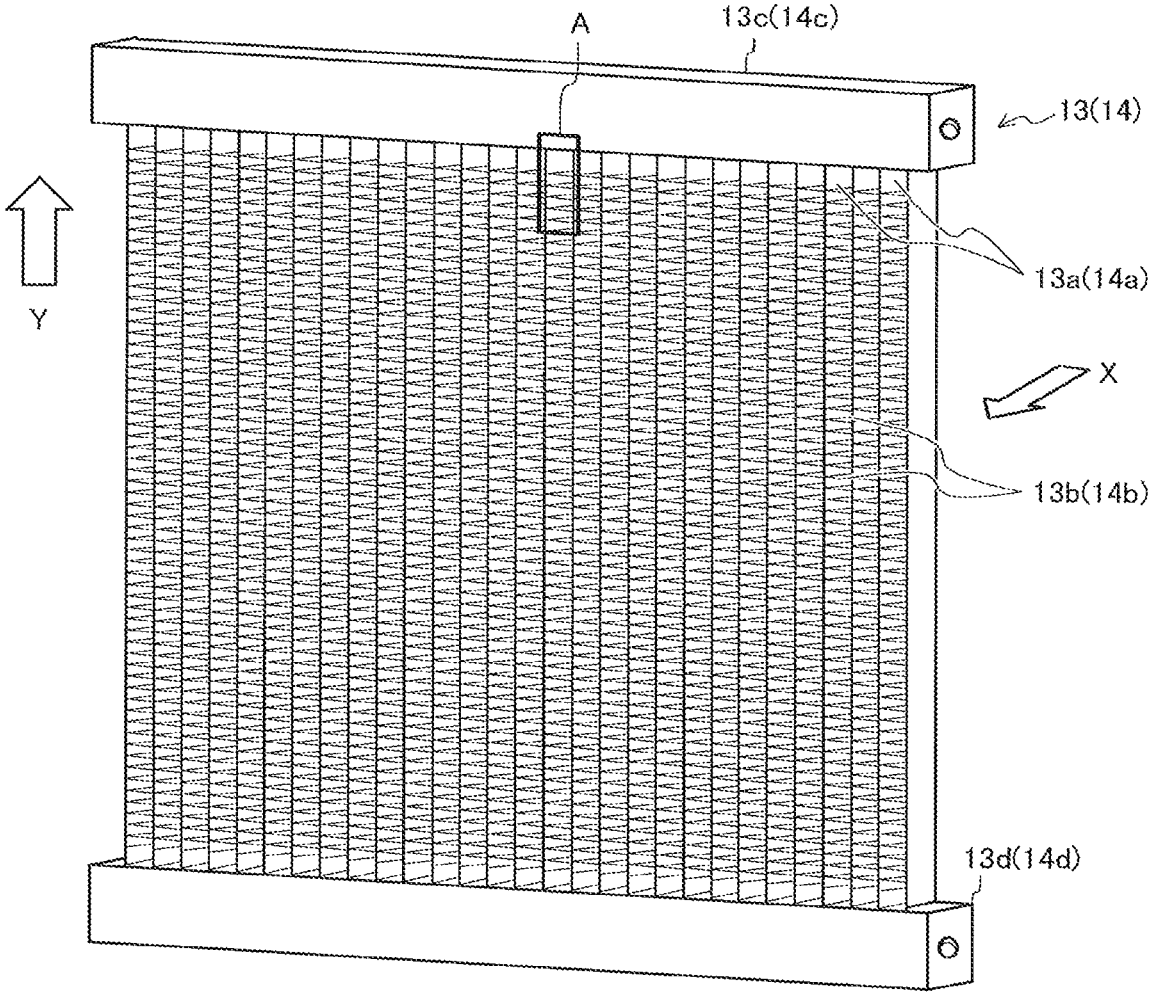
FIG. 4 is an external perspective view of one of heat source-side heat exchangers illustrated in FIG. 1.
Figure 5:
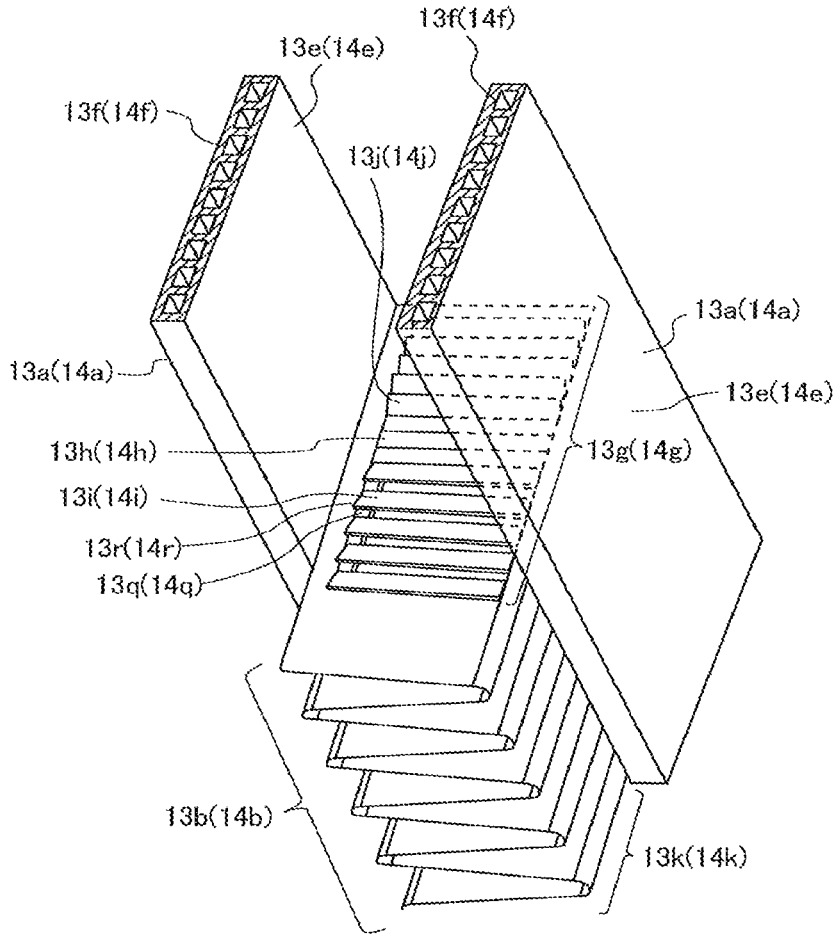
FIG. 5 is an enlarged partial perspective view of part A of the heat source-side heat exchanger illustrated in FIG. 4.

The structure of the heat source-side heat exchangers 13 and 14 will be described below with reference to FIGS. 4 and 5. FIG. 4 is an external perspective view of one of the heat source-side heat exchangers illustrated in FIG. 1. FIG. 5 is an enlarged partial perspective view of part A of the heat source-side heat exchanger illustrated in FIG. 4.

The heat source-side heat exchanger 13 (14) includes flat heat transfer tubes 13*a* (14*a*) arranged at intervals of, for example, 10 mm in a left-right direction, which is orthogonal to the direction of airflow X generated when the fan 16 is activated. The intervals are gaps between flat surfaces 13*e* (14*e*) of the flat heat transfer tubes 13*a* (14*a*) that face each other. The flat heat transfer tubes 13*a* (14*a*) each have a plurality of refrigerant passages 13*f* (14*f*) arranged at equal intervals in the direction of the airflow X. The airflow X that has passed between the flat heat transfer tubes 13*a* (14*a*) is sucked by the fan 16, thereby changing into airflow Y that flows upward.

Corrugated fins 13*b* (14*b*) are each, for example, a triangular-wave-shaped fin obtained by bending, for example, a thin plate of less than 1 mm into a zigzag shape in the vertical direction of the flat heat transfer tubes 13*a* (14*a*). Each corrugated fin 13*b* (14*b*) is in tight contact with and fixed to the flat surfaces 13*e* (14*e*) of the flat heat transfer tubes 13*a* (14*a*) that face each other except for end fins 13*k* (14*k*) that are provided at one end of the corrugated fin 13*b* (14*b*) and that project from the region between the flat heat transfer tubes 13*a* (14*a*) toward an upstream side of the airflow X.

Each corrugated fin 13*b* (14*b*) includes fins 13*g* (14*g*) in the region between the flat heat transfer tubes 13*a* (14*a*), each fin 13*g* (14*g*) having a drain hole 13*h* (14*h*), a plurality of first louvers 13*i* (14*i*), and a plurality of second louvers 13*j* (14*j*). The drain hole 13*h* (14*h*) is provided in each fin 13*g* (14*g*) adjacent to central regions of the flat heat transfer tubes 13*a* (14*a*) in the depth direction, which is the direction in which air flows. The drain hole 13*h* (14*h*) has an elongated rectangular shape that extends in the left-right direction, which is orthogonal to the depth direction and in which the flat heat transfer tubes are arranged. The width of the drain hole 13*h* (14*h*) in the depth direction is greater than or equal to one-half of the interval (maximum interval) of the zig-zag shape of the corrugated fin 13*b* (14*b*). The length of the drain hole 13*h* (14*h*) is greater than or equal to one-half of the length of the corrugated fin 13*b* (14*b*) in the left-right direction.

When the first louvers 13*i* (14*i*) are viewed from the upstream side of the airflow X, the first louvers 13*i* (14*i*) are located in front of the drain hole 13*h* (14*h*) of each fin 13*g* (14*g*) and arranged in the depth direction of the fin 13*g* (14*g*). The first louvers 13*i* (14*i*) each include a slit 13*q* (14*q*) through which air flows and a slat 13*r* (14*r*) that guides the air that flows through the slit 13*q* (14*q*). The first louvers 13*i* (14*i*) each have an elongated rectangular shape that extends in the left-right direction, which is orthogonal to the depth direction of each fin 13*g* (14*g*), and each have an upstream end in the airflow X. The upstream end is inclined upward. In other words, the first louvers 13*i* (14*i*) are inclined in such a manner that each fin 13*g* (14*g*) extends along a horizontal plane and upstream portions of the first louvers 13*i* (14*i*) in the direction of the airflow X are shifted upward.

Similarly, when the second louvers 13*j* (14*j*) are viewed from the upstream side of the airflow X, the second louvers 13*j* (14*j*) are located behind the drain hole 13*h* (14*h*) of each fin 13*g* (14*g*) and arranged in the depth direction of the fin 13*g* (14*g*). Similar to the first louvers 13*i* (14*i*), the second louvers 13*j* (14*j*) each include a slit 13*q* (14*q*) through which air flows and a slat 13*r* (14*r*) that guides the air that flows through the slit 13*q* (14*q*). The second louvers 13*j* (14*j*) each have an elongated rectangular shape that extends in the left-right direction, which is orthogonal to the depth direction of each fin 13*g* (14*g*), and are each have a downstream end in the airflow X. The downstream end is inclined upward. In other words, the second louvers 13*j* (14*j*) are inclined in such a manner that each fin 13*g* (14*g*) extends along a horizontal plane and downstream portions of the second louvers 13*j* (14*j*) in the direction of the airflow X are shifted upward.

The above-described first louvers 13*i* (14*i*) and the above-described second louvers 13*j* (14*j*) are each provided by making a rectangular cut in each fin 13*g* (14*g*) while leaving uncut portions having the same length at both ends in the left-right direction of the fin 13*g* (14*g*) and then twisting both ends of the rectangular cut by a predetermined angle to provide the slat 13*r* (14*r*). When the slats 13*r* (14*r*) of the first louvers 13*i* (14*i*) and the second louvers 13*j* (14*j*) are obtained by providing cuts in the fin 13*g* (14*g*), the slits 13*q* (14*q*) are provided as openings in the fin 13*g* (14*g*).

The flat heat transfer tubes 13*a* (14*a*) and the corrugated fins 13*b* (14*b*) are made from aluminum, which is highly thermally conductive. The flat heat transfer tubes 13*a* (14*a*) and the corrugated fins 13*b* (14*b*) are connected to each other by a metal joining method, such as Nocolok brazing. Although the flat heat transfer tubes 13*a* (14*a*) and the corrugated fins 13*b* (14*b*) are both made from aluminum herein, the flat heat transfer tubes 13*a* (14*a*) and the corrugated fins 13*b* (14*b*) are not necessarily made from the same material.

Figure 6:
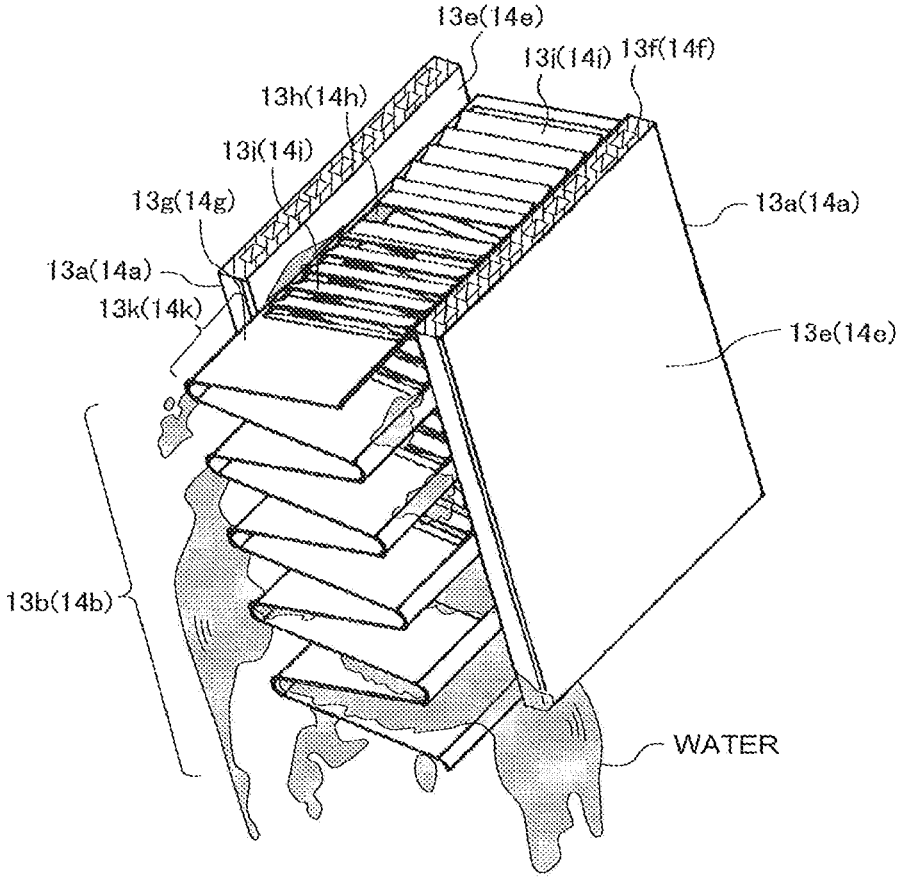
FIG. 6 is a schematic perspective view illustrating the manner in which water is drained from a corrugated fin illustrated in FIG. 5.
Figure 7:
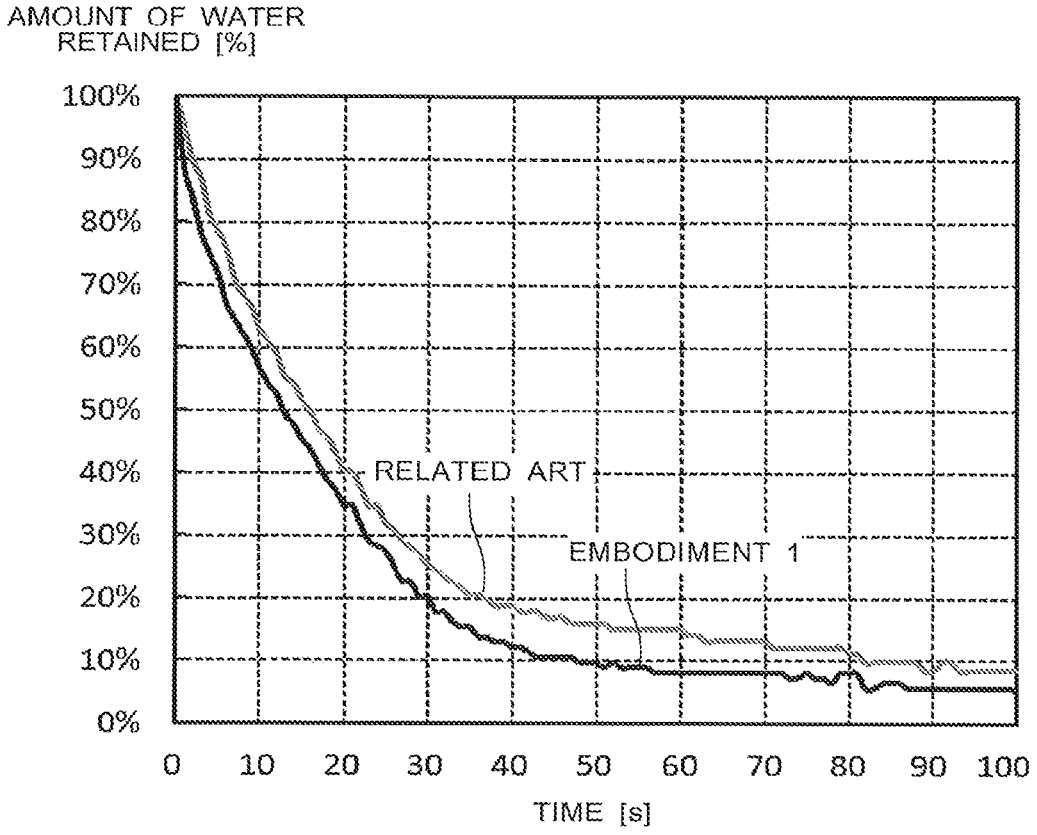
FIG. 7 is a graph showing the amount of water retained on the corrugated fin illustrated in FIG. 5 over time.

FIG. 6 is a schematic perspective view illustrating the manner in which water is drained from the corrugated fin illustrated in FIG. 5. FIG. 7 is a graph showing the amount of water retained on the corrugated fin illustrated in FIG. 5 over time.

When the heat source-side heat exchanger 13 (14) according to Embodiment 1 is immersed in a water tank and lifted out, water is drained from each corrugated fin 13*b* (14*b*) as illustrated in FIG. 6. More specifically, with the heat source-side heat exchanger 13 (14) of Embodiment 1, when the corrugated fin 13*b* (14*b*) is viewed in the direction of the airflow X, water on the end fins 13*k* (14*k*) flows toward the lower portions of the end fins 13*k* (14*k*) (in the left-right direction) and falls, and water on the first louvers 13*i* (14*i*) and the second louvers 13*j* (14*j*) falls through the openings of the first louvers 13*i* (14*i*) and the second louvers 13*j* (14*j*). In addition, water in the regions between the first louvers 13*i* (14*i*) and the second louvers 13*j* (14*j*) flows toward the lower portions of the fins 13*g* (14*g*) and falls through the drain holes 13*h* (14*h*).

The heat source-side heat exchanger 13 (14) according to Embodiment 1 and the above-described heat exchanger in the related art were immersed in a water tank and then lifted out, and water remaining on the heat source-side heat exchanger 13 (14) and water remaining on the heat exchanger in the related art were measured with a weight scale. The result of the measurement will be described with reference to FIG. 7.

When the heat source-side heat exchanger 13 (14) according to Embodiment 1 is lifted out of the water tank and measurement is made over time, reduction in the amount of water retained on the heat source-side heat exchanger 13 (14) is greater than reduction in the amount of water retained on the heat exchanger in the related art. In particular, when the elapsed time is 50 seconds, the amount of water retained on the heat exchanger in the related art is greater than 10% and less than or equal to 20%. In contrast, the amount of water retained on the heat source-side heat exchanger 13 (14) according to Embodiment 1 is less than or equal to 10%. This is because the heat exchanger in the related art retains a large amount of water as the louvers of the heat exchanger in the related art are oriented horizontally to the corrugated fin, whereas the heat source-side heat exchanger 13 (14) according to Embodiment 1 is configured in such a manner that water does not remain on the corrugated fins 13*b* (14*b*) as described above and therefore have high drainage performance.

As described above, according to Embodiment 1, each corrugated fin 13*b* (14*b*) includes the fins 13*g* (14*g*) in the region between the flat heat transfer tubes 13*a* (14*a*), and each fin 13*g* (14*g*) has the drain hole 13*h* (14*h*) at the center of the fin 13*g* (14*g*) in the depth direction. In addition, the first louvers 13*i* (14*i*) are provided in front of the drain hole 13*h* (14*h*) in each fin 13*g* (14*g*), and the second louvers 13*j* (14*j*) are provided behind the drain hole 13*h* (14*h*) in each fin 13*g* (14*g*).

The corrugated fins 13*b* (14*b*) having the above-described structure are attached between the flat heat transfer tubes 13*a* (14*a*). Consequently, drainage of water from the corrugated fins 13*b* (14*b*) during the heating operation can be improved, and the amount of residual water can be reduced. As a result, water does not easily freeze on the corrugated fins 13*b* (14*b*), and heat exchange efficiency can be increased.

Embodiment 2

Figure 8:
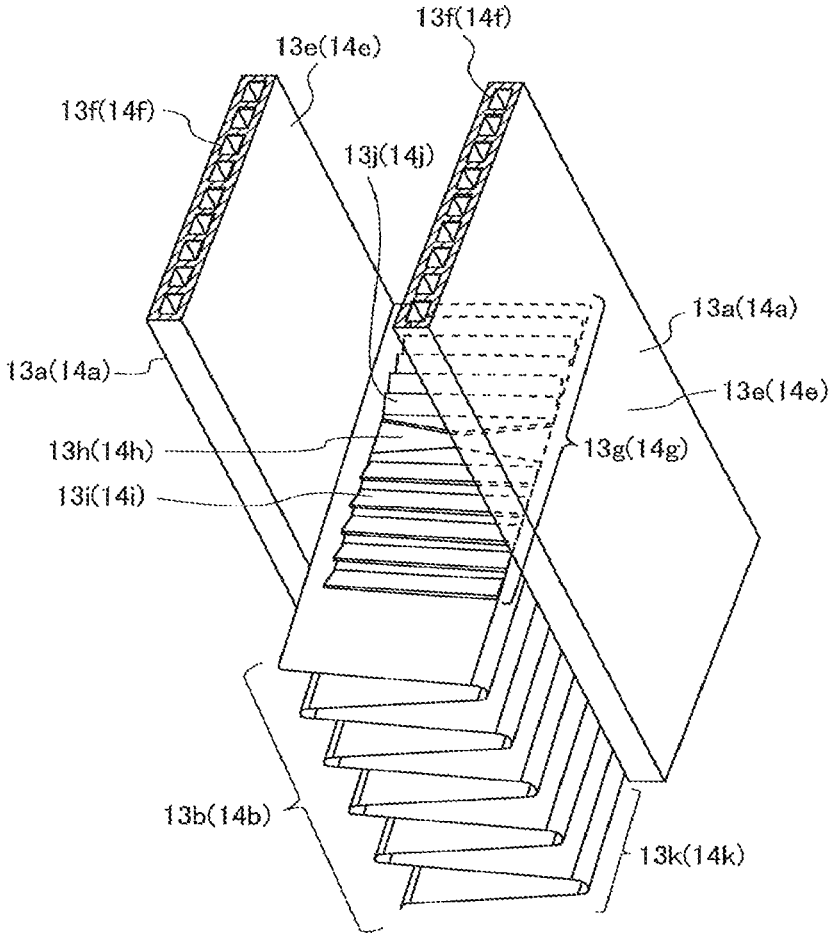
FIG. 8 is a schematic perspective view of a portion of a heat source-side heat exchanger included in an air-conditioning apparatus according to Embodiment 2 of the present invention.
Figure 9:
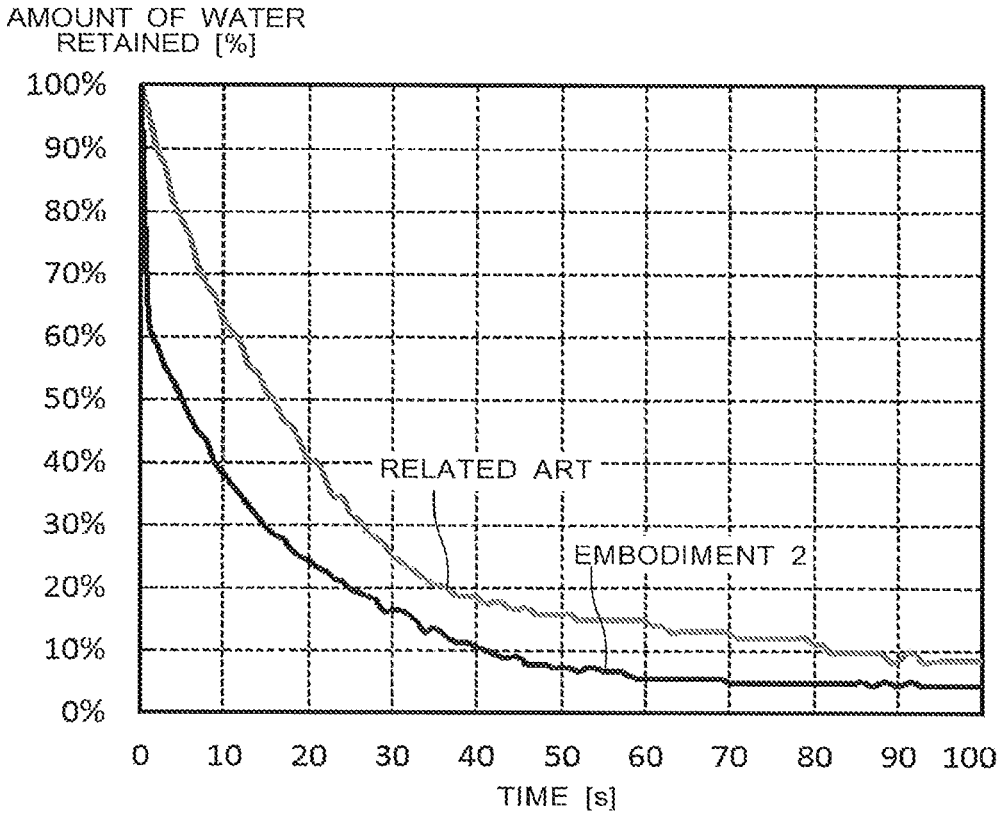
FIG. 9 is a graph showing the amount of water retained on a corrugated fin illustrated in FIG. 8 over time.

FIG. 8 is a schematic perspective view of a portion of a heat source-side heat exchanger included in an air-conditioning apparatus according to Embodiment 2 of the present invention. FIG. 9 is a graph showing the amount of water retained on a corrugated fin illustrated in FIG. 8 over time.

In Embodiment 2, the shape of drain holes 13*h* (14*h*) provided in each corrugated fin 13*b* (14*b*) differs from that in Embodiment 1. As illustrated in FIG. 8, similar to Embodiment 1, each corrugated fin 13*b* (14*b*) includes fins 13*g* (14*g*) in the region between flat heat transfer tubes 13*a* (14*a*), and each fin 13*g* (14*g*) has the drain hole 13*h* (14*h*) at the center of the fin 13*g* (14*g*) in the depth direction. The drain hole 13*h* (14*h*) is shaped in such a manner that the width of the drain hole 13*h* (14*h*) gradually decreases from both ends toward the center in the left-right direction orthogonal to the depth direction of each fin 13*g* (14*g*).

A plurality of first louvers 13*i* (14*i*) are provided in front of the drain hole 13*h* (14*h*) in each fin 13*g* (14*g*) of each corrugated fin 13*b* (14*b*). In addition, a plurality of second louvers 13*j* (14*j*) are provided behind the drain hole 13*h* (14*h*) in each fin 13*g* (14*g*) of each corrugated fin 13*b* (14*b*).

A heat source-side heat exchanger 13 (14) including the corrugated fins 13*b* (14*b*) having the above-described structure and the above-described heat exchanger in the related art were immersed in a water tank and then lifted out, and water remaining on the heat source-side heat exchanger 13 (14) and water remaining on the heat exchanger in the related art were measured with a weight scale. FIG. 9 shows the result of the measurement. In about 2 seconds after the removal from the water tank, the amount of water retained on the heat source-side heat exchanger 13 (14) according to Embodiment 2 is reduced by about 40%, which is greater than the amount of reduction in the amount of water retained on the heat exchanger in the related art. In addition, when the elapsed time is 40 seconds, the amount of water retained on the heat exchanger in the related art is greater than 10% and less than or equal to 20%. In contrast, the amount of water retained on the heat source-side heat exchanger 13 (14) according to Embodiment 2 is less than or equal to 10%. This is because the heat exchanger in the related art retains a large amount of water as the louvers of the heat exchanger in the related art are oriented horizontally to the corrugated fin, whereas the heat source-side heat exchanger 13 (14) according to Embodiment 2 is configured in such a manner that water does not remain on the corrugated fins 13*b* (14*b*).

More specifically, with the heat source-side heat exchanger 13 (14) of Embodiment 2, when each corrugated fin 13*b* (14*b*) is viewed in the direction of the airflow X, water on end fins 13*k* (14*k*) flows toward the lower portions of the end fins 13*k* (14*k*) (in the left-right direction) and falls, and water on the first louvers 13*i* (14*i*) and the second louvers 13*j* (14*j*) falls through the openings of the first louvers 13*i* (14*i*) and the second louvers 13*j* (14*j*). In addition, water in the regions between the first louvers 13*i* (14*i*) and the second louvers 13*j* (14*j*) flows toward the lower portions of the fins 13*g* (14*g*) and falls through the drain holes 13*h* (14*h*). As lower portions of the drain holes 13*h* (14*h*) in the fins 13*g* (14*g*) have a width that gradually increases from the centers toward the ends of the fins 13*g* (14*g*), the water around the drain holes 13*h* (14*h*) flows into the drain holes 13*h* (14*h*) before forming water droplets due to surface tension.

As described above, according to Embodiment 2, each corrugated fin 13*b* (14*b*) includes the fins 13*g* (14*g*) that each have the drain hole 13*h* (14*h*) shaped in such a manner that the width of the drain hole 13*h* (14*h*) gradually decreases from both ends toward the center in the left-right direction orthogonal to the depth direction of each fin 13*g* (14*g*). In addition, the first louvers 13*i* (14*i*) are provided in front of the drain hole 13*h* (14*h*) in each fin 13*g* (14*g*), and the second louvers 13*j* (14*j*) are provided behind the drain hole 13*h* (14*h*) in each fin 13*g* (14*g*).

The corrugated fins 13*b* (14*b*) having the above-described structure are attached between the flat heat transfer tubes 13*a* (14*a*). Consequently, drainage of water from the corrugated fins 13*b* (14*b*) during the heating operation can be improved, and the amount of residual water can be reduced. As a result, water does not easily freeze on the corrugated fins 13*b* (14*b*), and heat exchange efficiency can be increased.

Embodiment 3

Figure 10:
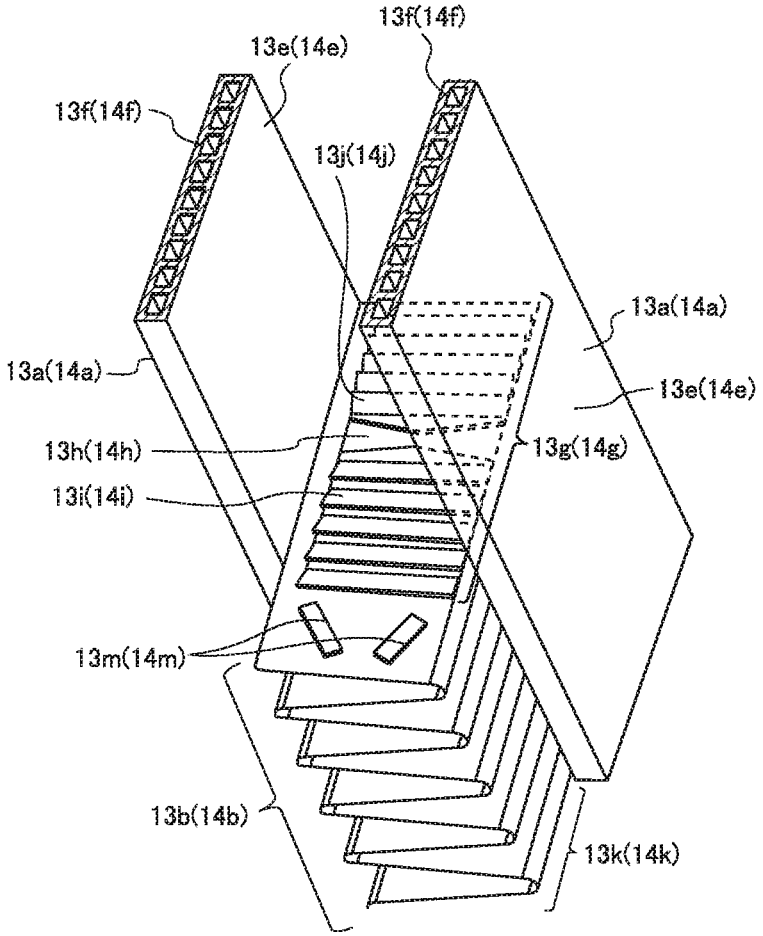
FIG. 10 is a schematic perspective view of a portion of a heat source-side heat exchanger included in an air-conditioning apparatus according to Embodiment 3 of the present invention.
Figure 11:
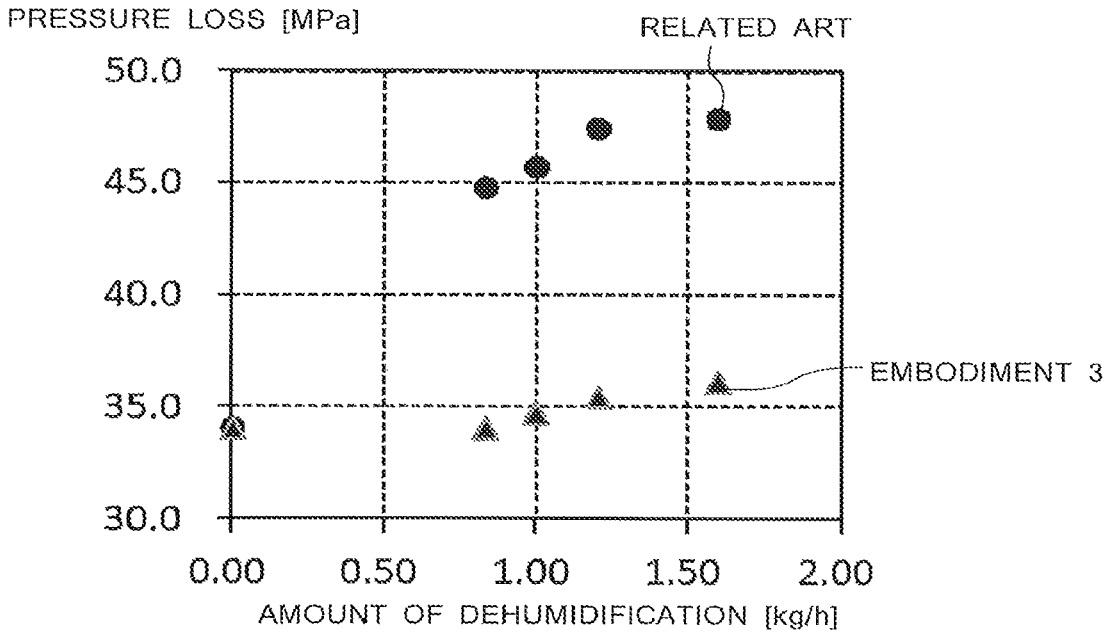
FIG. 11 is a graph showing the variation in pressure loss to the amount of dehumidification of a corrugated fin illustrated in FIG. 10.

FIG. 10 is a schematic perspective view of a portion of a heat source-side heat exchanger included in an air-conditioning apparatus according to Embodiment 3 of the present invention. FIG. 11 is a graph showing the variation in pressure loss to the amount of dehumidification of a corrugated fin illustrated in FIG. 10.

In Embodiment 3, two water guiding projections 13*m* (14*m*) are provided on each end fin 13*k* (14*k*) of each corrugated fin 13*b* (14*b*) according to Embodiment 2. The two water guiding projections 13*m* (14*m*) on each end fin 13*k* (14*k*) are each inclined toward a corresponding one of the flat heat transfer tubes 13*a* (14*a*) in such a manner that a gap between the water guiding projections 13*m* (14*m*) increases from the upstream ends to downstream ends of the water guiding projections 13*m* (14*m*) in the direction of the airflow X.

A plurality of first louvers 13*i* (14*i*) are provided in front of the drain hole 13*h* (14*h*) in each fin 13*g* (14*g*) of each corrugated fin 13*b* (14*b*). In addition, a plurality of second louvers 13*j* (14*j*) are provided behind the drain hole 13*h* (14*h*) in each fin 13*g* (14*g*) of each corrugated fin 13*b* (14*b*).

When a heat source-side heat exchanger 13 (14) including the corrugated fins 13*b* (14*b*) having the above-described structure is used in a heating operation, water droplets are formed on the end fins 13*k* (14*k*). Some of the water droplets move toward the lower portions of the end fins 13*k* (14*k*) (in the left-right direction), and the remaining water droplets are sucked by the fan and move in the depth direction of the corrugated fin 13*b* (14*b*). Some of the water droplets that have moved in the depth direction come into contact with the two water guiding projections 13*m* (14*m*) and are guided by the two water guiding projections 13*m* (14*m*) toward the flat heat transfer tubes 13*a* (14*a*) on both sides.

As illustrated in FIG. 11, when the two water guiding projections 13*m* (14*m*) are provided on each end fin 13*k* (14*k*), the pressure loss relative to the amount of dehumidification is less than that in the above-described heat exchanger in the related art. FIG. 11 shows the pressure loss caused when the velocity of the airflow X is 2 m/s. With the heat exchanger of the related art, when the amount of dehumidification increases, the airflow X is impeded by water that accumulates in the central region of the corrugated fin, and the pressure loss increases accordingly. In contrast, with the corrugated fin 13*b* (14*b*) of Embodiment 3, the two water guiding projections 13*m* (14*m*) on each end fin 13*k* (14*k*) cause the water droplets on the end fin 13*k* (14*k*) to move toward the flat heat transfer tubes 13*a* (14*a*), so that a sufficient flow passage is provided for the airflow X and the pressure loss is not increased.

As described above, each end fin 13*k* (14*k*) of each corrugated fin 13*b* (14*b*) has the two water guiding projections 13*m* (14*m*) that guide the water droplets on the end fin 13*k* (14*k*) toward the flat heat transfer tubes 13*a* (14*a*) on both sides. Consequently, the pressure loss is not increased due to the accumulated water droplets, and the heat exchange efficiency of the heat source-side heat exchanger 13 (14) is increased.

In Embodiment 3, the two water guiding projections 13*m* (14*m*) are provided on each end fin 13*k* (14*k*) of the corrugated fin 13*b* (14*b*) according to Embodiment 2. However, the two water guiding projections 13*m* (14*m*) may instead be provided on each end fin 13*k* (14*k*) of the corrugated fin 13*b* (14*b*) according to Embodiment 2.

Embodiment 4

Figure 12:
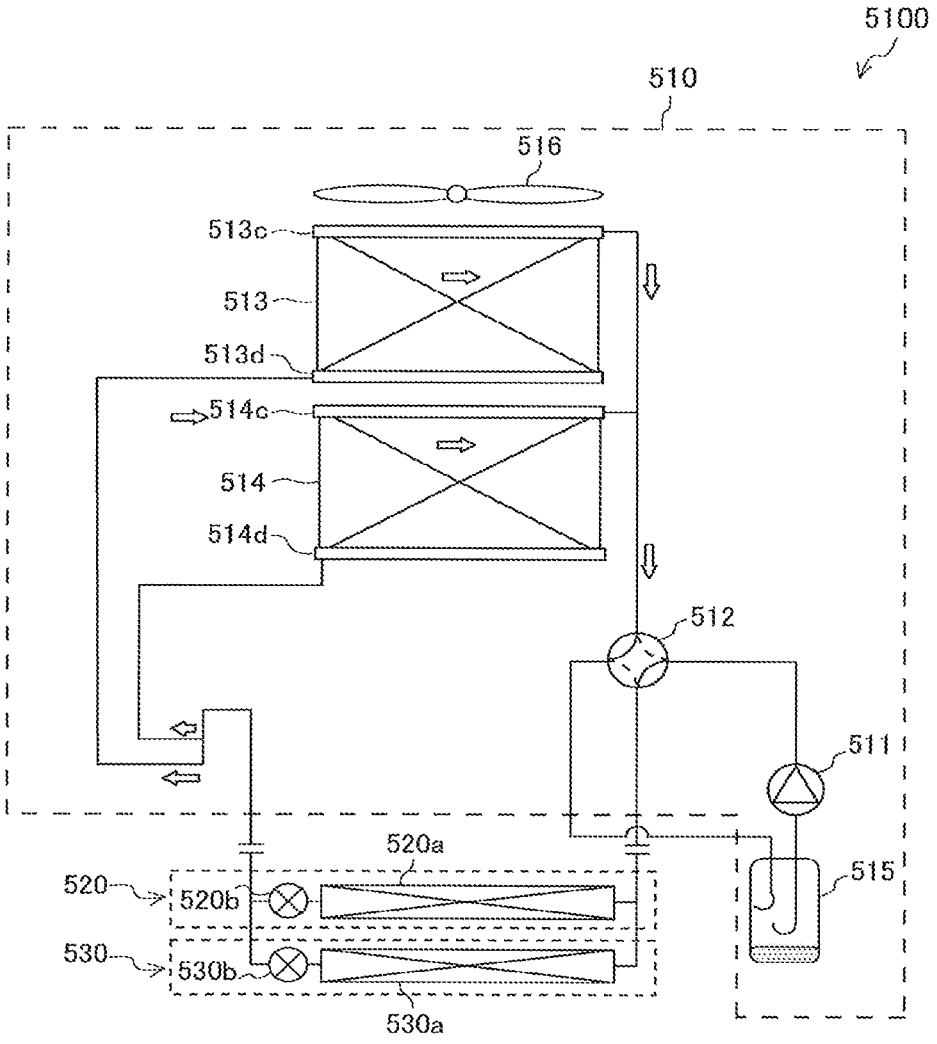
FIG. 12 is a refrigerant circuit diagram illustrating the overall structure of an air-conditioning apparatus according to Embodiment 4 of the present invention.
Figure 13:
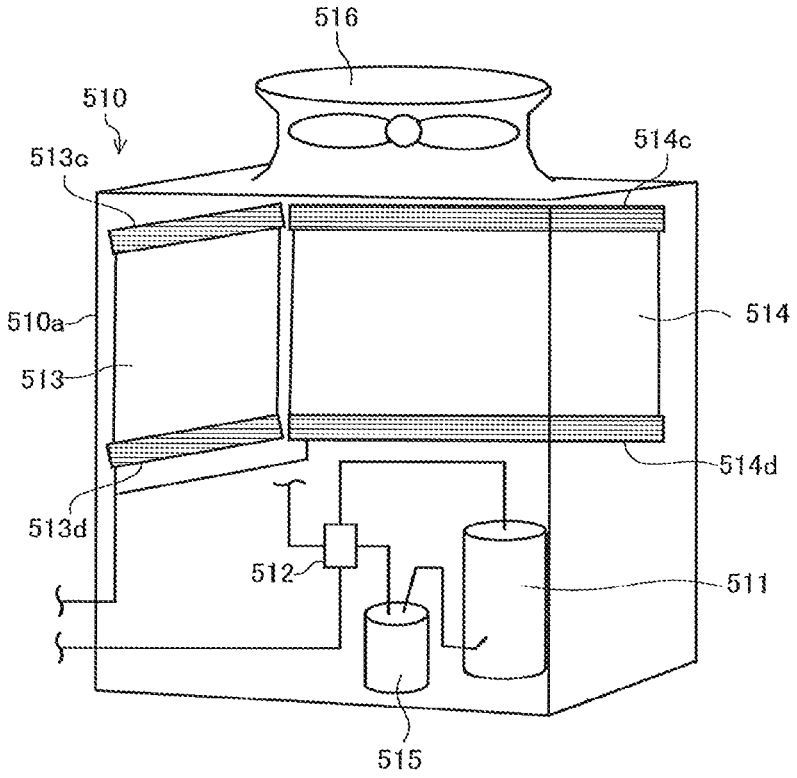
FIG. 13 is a schematic see-through perspective view of a heat source-side unit illustrated in FIG. 12.
Figure 14:
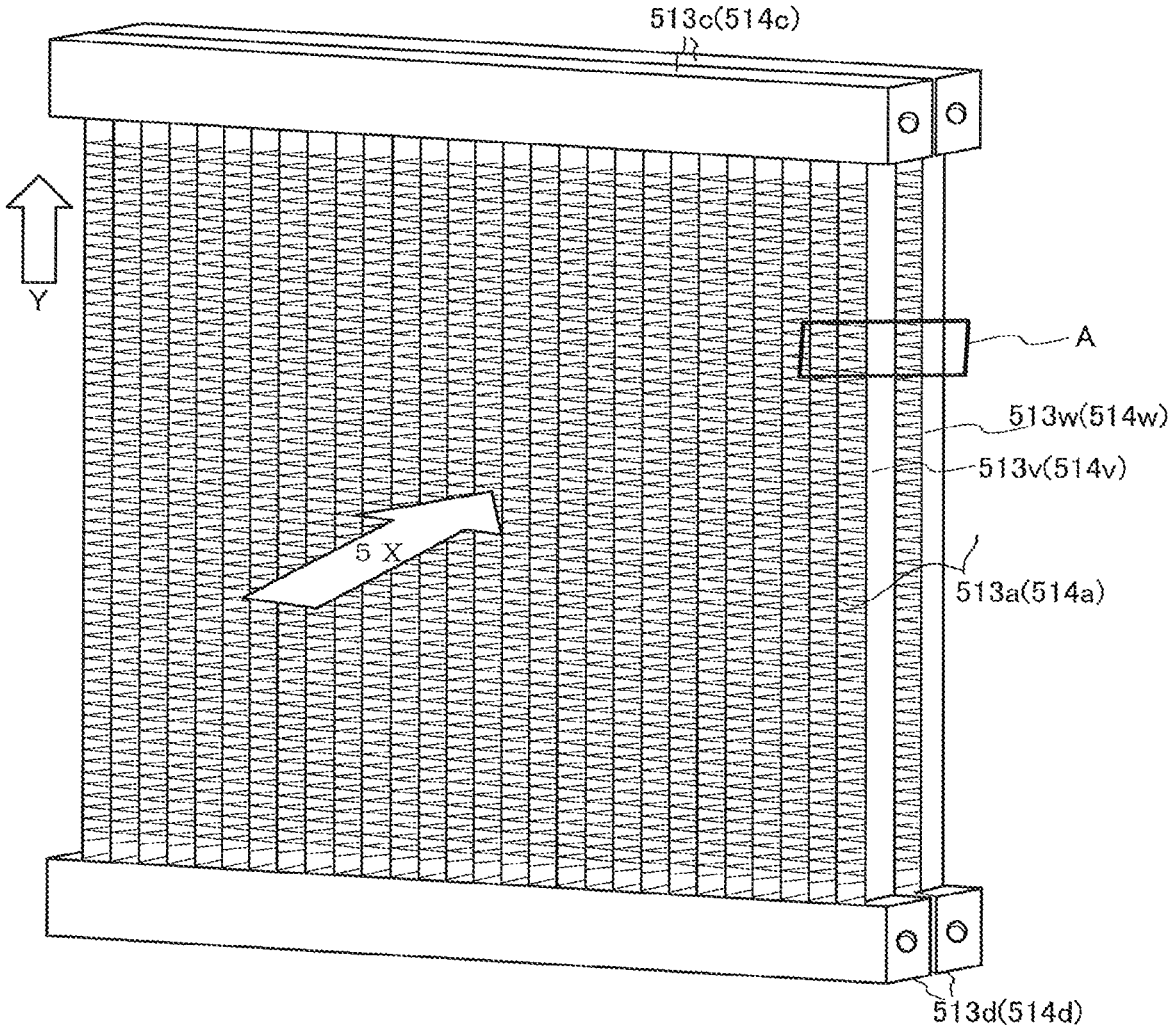
FIG. 14 is an external perspective view of a heat source-side heat exchanger according to Embodiment 4.
Figure 15:
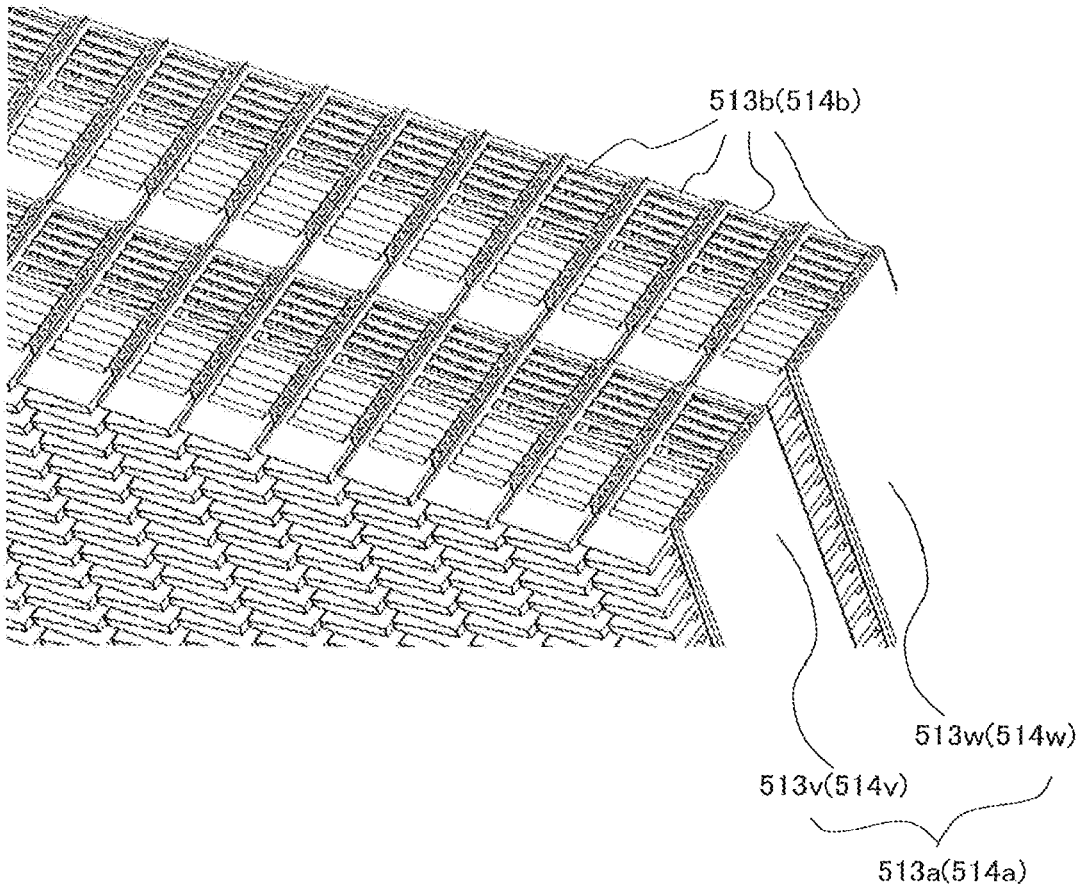
FIG. 15 is an enlarged partial perspective view of part A of the heat source-side heat exchanger illustrated in FIG. 14.
Figure 16:
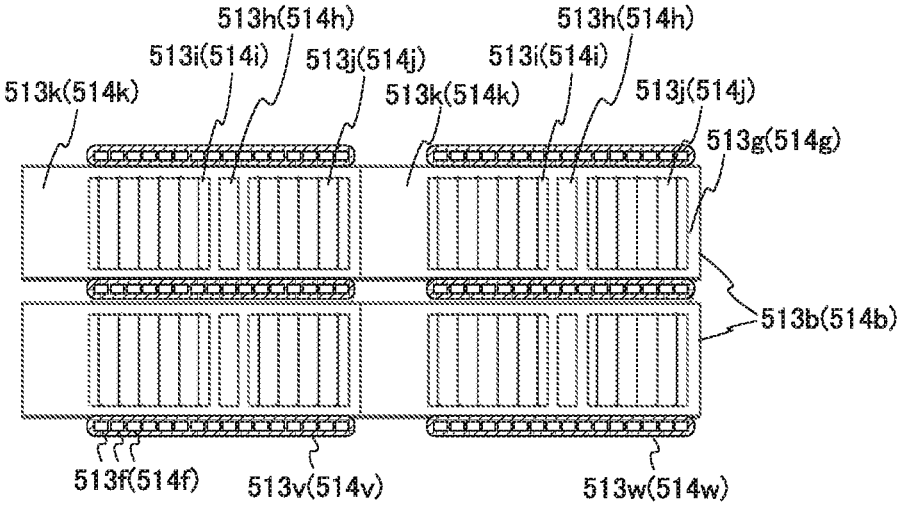
FIG. 16 is a top view of corrugated fins according to Embodiment 4 of the present invention.
Figure 17:
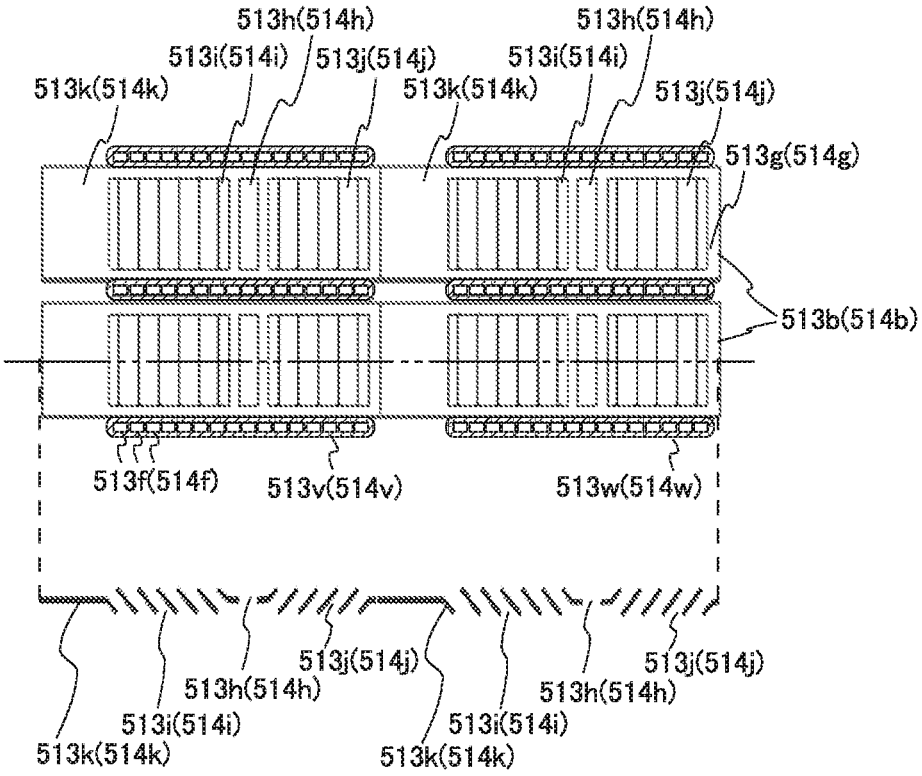
FIG. 17 shows a sectional view of the corrugated fins according to Embodiment 4 of the present invention.
Figure 18:
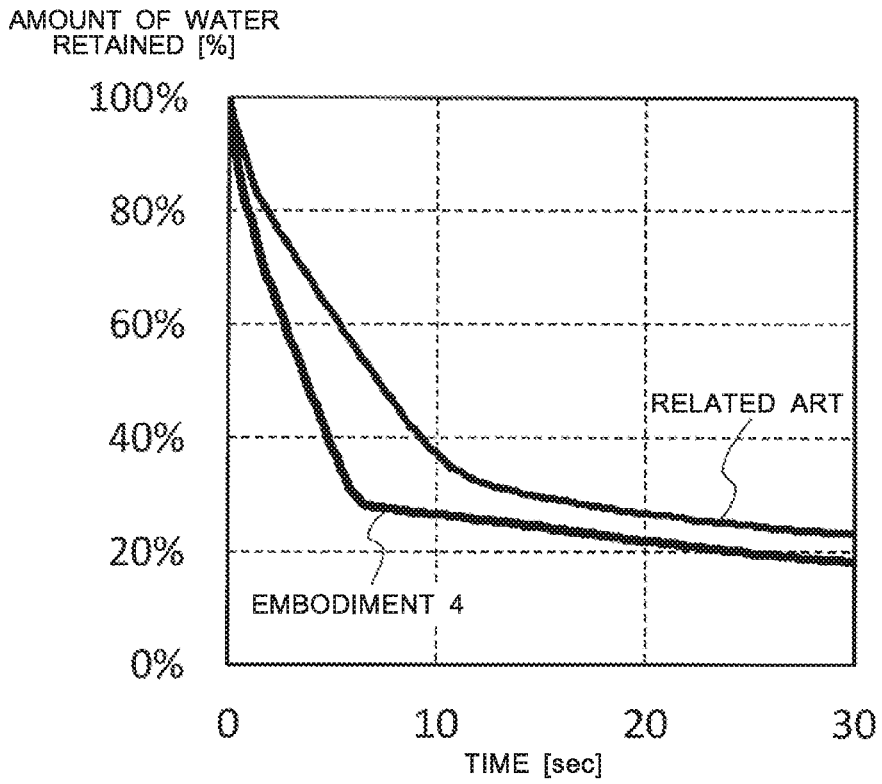
FIG. 18 is a graph showing the amount of water retained on the corrugated fins according to Embodiment 4 of the present invention over time.

FIG. 12 is a refrigerant circuit diagram illustrating the overall structure of an air-conditioning apparatus according to Embodiment 4 of the present invention. FIG. 13 is a schematic see-through perspective view of a heat source-side unit illustrated in FIG. 12. FIG. 14 is an external perspective view of a heat source-side heat exchanger according to Embodiment 4 of the present invention. FIG. 15 is an enlarged partial perspective view of part A of the heat source-side heat exchanger illustrated in FIG. 14. FIG. 16 is a top view of corrugated fins according to Embodiment 4 of the present invention. FIG. 17 shows a sectional view of the corrugated fins according to Embodiment 4 of the present invention. FIG. 18 is a graph showing the amount of water retained on the corrugated fins according to Embodiment 4 of the present invention over time.

An air-conditioning apparatus 5100 according to Embodiment 4 is, for example, a variable refrigerant flow system including a heat source-side unit 510, a use-side unit 520 connected to the heat source-side unit 510, and another use-side unit 530 connected in parallel to the use-side unit 520. The heat source-side unit 510 is disposed outdoors. The use-side units 520 and 530 are disposed indoors in spaces to be air conditioned. Although two use-side units 520 and 530 are connected to the heat source-side unit 510 in Embodiment 4, the number of use-side units 520 and 530 is not limited.

The heat source-side unit 510 includes a compressor 511, a flow switching device 512, heat source-side heat exchangers (each corresponding to a heat exchanger according to the present invention) 513 and 514, an accumulator 515, and a fan 516. The use-side unit 520 includes a use-side heat exchanger 520*a*, an expansion device 520*b*, and a fan (not shown). Similar to the use-side unit 520, the use-side unit 530 includes a use-side heat exchanger 530*a*, an expansion device 530*b*, and a fan. The compressor 511, the flow switching device 512, the heat source-side heat exchangers 513 and 514, the accumulator 515, the use-side heat exchangers 520*a* and 530*a*, and the expansion devices 520*b* and 530*b* are connected to each other by refrigerant pipes to enable refrigerant to circulate to selectively perform a cooling operation and a heating operation.

The compressor 511 sucks in low-temperature low-pressure refrigerant and compresses the refrigerant into a high-temperature high-pressure state. The compressor 511 is, for example, a scroll compressor, a reciprocating compressor, or a vane compressor. The flow switching device 512 switches a flow passage to a heating-operation flow passage or a cooling-operation flow passage depending on whether the operation mode is to be a cooling operation or a heating operation. The flow switching device 512 is, for example, a four-way valve.

The flow switching device 512 connects a discharge port of the compressor 511 to the use-side heat exchangers 520*a* and 530*a* and connects a suction port of the compressor 511 to the heat source-side heat exchangers 513 and 514 with the accumulator 515 provided between the compressor 511 and the heat source-side heat exchangers 513 and 514 during the heating operation. The flow switching device 512 connects the discharge port of the compressor 511 to the heat source-side heat exchangers 513 and 514 and connects the suction port of the compressor 511 to the use-side heat exchangers 520*a* and 530*a* with the accumulator 515 provided between the compressor 511 and the use-side heat exchangers 520*a* and 530*a* during the cooling operation. Although the flow switching device 512 is a four-way valve in this example, the flow switching device 512 is not limited to this example, and may instead be a combination of a plurality of two-way valves.

As illustrated in FIG. 13, the heat source-side heat exchangers 513 and 514 are arranged in an L-shape along one side surface and a back surface of a housing 510*a* of the heat source-side unit 510 in an upper region of the housing 510*a*. The heat source-side heat exchangers 513 and 514 include flat heat transfer tubes, corrugated fins disposed between the flat heat transfer tubes, upper headers 513*c* and 514*c* attached to the top ends of the flat heat transfer tubes, and lower headers 513*d* and 514*d* attached to the bottom ends of the flat heat transfer tubes. Each flat heat transfer tube is a heat transfer tube having a flat shape and a flow passage structure including a plurality of flow passages (microchannels). The upper headers 513*c* and 514*c* are connected to the flow switching device 512, and the lower headers 513*d* and 514*d* are connected to the use-side unit 520. The structure of the heat source-side heat exchangers 513 and 514 will be described in detail below.

The accumulator 515, which is connected to the suction port of the compressor 511, separates refrigerant that flows into the accumulator 515 from the flow switching device 512 into gas refrigerant and liquid refrigerant. Among the gas refrigerant and the liquid refrigerant separated from each other by the accumulator 515, the gas refrigerant is sucked into the compressor 511. The fan 516 is disposed in the upper region of the housing 510*a* of the heat source-side unit 510. The fan 516 sucks outside air through the heat source-side heat exchangers 513 and 514 and discharges the air upward.

The expansion devices 520*b* and 530*b* are disposed between the use-side heat exchangers 520*a* and 530*a* and the heat source-side heat exchangers 513 and 514. The expansion devices 520*b* and 530*b* are, for example, linear electronic expansion valves (LEV) capable of adjusting the flow rate of the refrigerant. The expansion devices 520*b* and 530*b* adjust the pressure and temperature of the refrigerant. The expansion devices 520*b* and 530*b* may instead be, for example, on-off valves that open and close to enable and disable the flow of the refrigerant.

The heating operation of the air-conditioning apparatus 5100 having the above-described structure will be described below with reference to FIG. 12. The compressor 511 sucks in gas refrigerant and compresses the refrigerant into high-temperature high-pressure gas refrigerant. The high-temperature high-pressure gas refrigerant is discharged from the compressor 511 and flows through the flow switching device 512 and into the use-side heat exchangers 520*a* and 530*a*. The high-temperature high-pressure gas refrigerant that has flowed into the use-side heat exchangers 520*a* and 530*a* exchanges heat with indoor air supplied by the fans included in the use-side units 520 and 530, thereby rejecting heat and being condensed into low-temperature high-pressure liquid refrigerant, which flows out of the use-side heat exchangers 520*a* and 530*a*. The low-temperature high-pressure liquid refrigerant that has flowed out of the use-side heat exchangers 520*a* and 530*a* is expanded and reduced in pressure by the expansion devices 520*b* and 530*b*, to change into low-temperature low-pressure two-phase gas-liquid refrigerant, which flows out of the use-side units 520 and 530.

The low-temperature low-pressure two-phase gas-liquid refrigerant that has flowed out of the use-side units 520 and 530 flows into the heat source-side heat exchangers 513 and 514 through the lower headers 513*d* and 514*d*. The low-temperature low-pressure two-phase gas-liquid refrigerant that has flowed into the heat source-side heat exchangers 513 and 514 exchanges heat with outside air supplied by the fan 516, thereby absorbing heat and being evaporated into low-pressure gas refrigerant, which flows out from the upper headers 513*c* and 514*c*. The low-pressure gas refrigerant flows through the flow switching device 512 and into the accumulator 515. The low-pressure gas refrigerant that has flowed into the accumulator 515 is separated into liquid refrigerant and gas refrigerant, and low-temperature low-pressure gas refrigerant is sucked into the compressor 511 again. The gas refrigerant sucked into the compressor 511 is discharged after being compressed by the compressor 511 again. Thus, the refrigerant is continuously circulated.

FIG. 14 is an external perspective view of the heat source-side heat exchanger according to Embodiment 4 of the present invention. FIG. 15 is an enlarged partial perspective view of part A of the heat source-side heat exchanger according to Embodiment 4 of the present invention. The structure of the heat source-side heat exchangers 513 and 514 will be described below with reference to FIGS. 14 and 15. Although the heat source-side heat exchanger 513 will be described with reference to FIGS. 14 and 15, the heat source-side heat exchanger 514 has a similar structure.

The heat source-side heat exchanger 513 (514) includes flat heat transfer tubes 513*a* (514*a*) arranged at intervals of, for example, 10 mm in a left-right direction, which is orthogonal to the direction of airflow 5X generated when the fan 516 is activated. The intervals are gaps between flat surfaces 513*e* (514*e*) of the flat heat transfer tubes 513*a* (514*a*) that face each other. The flat heat transfer tubes 513*a* (514*a*) each have a plurality of refrigerant passages 513*f* (514*f*) arranged at equal intervals in the direction of the airflow 5X. As illustrated in FIG. 15, the flat heat transfer tubes 513*a* (514*a*) according to Embodiment 4 includes first flat heat transfer tubes 513*v* (514*v*) disposed at an upstream side of the airflow 5X and second flat heat transfer tubes 513*w* (514*w*) disposed downstream in the airflow 5X. The airflow 5X that has passed between the flat heat transfer tubes 513*a* (514*a*) is sucked by the fan 516, thereby changing into airflow Y that flows upward.

Corrugated fins 513*b* (514*b*) are each, for example, a triangular-wave-shaped fin obtained by bending, for example, a thin plate of less than 1 mm into a zigzag shape in the vertical direction of the flat heat transfer tubes 513*a* (514*a*). Each corrugated fin 513*b* (514*b*) is in tight contact with and fixed to the flat surfaces 513*e* (514*e*) of the flat heat transfer tubes 513*a* (514*a*) that face each other. However, end fins 513*k* (514*k*) that are provided at one end of each corrugated fin 513*b* (514*b*) and that project from the region between the flat heat transfer tubes 513*a* (514*a*) toward the upstream side of the airflow 5X are not fixed.

aAs illustrated in FIG. 16, the corrugated fins 513*b* (514*b*) include fins that each have two drain holes 513*h* (514*h*) in correspondence with the number of flat heat transfer tubes 513*a* (514*a*). The drain holes 513*h* (514*h*) have an elongated rectangular shape that extends in the left-right direction, which is orthogonal to the depth direction of the corrugated fins 513*b* (514*b*). More specifically, the drain holes 513*h* (514*h*) are provided at locations adjacent to substantially the center of the first flat heat transfer tubes 513*v* (514*v*) in the direction of the airflow 5X. The drain holes 513*h* (514*h*) are also provided at locations adjacent to substantially the center of the second flat heat transfer tubes 513*w* (514*w*) in the direction of the airflow 5X.

As illustrated in FIGS. 16 and 17, each corrugated fin 513*b* (514*b*) includes a plurality of first louvers 513*i* (514*i*) and a plurality of second louvers 513*j* (514*j*). Similar to the first louvers 13*i* (14*i*) and the second louvers 13*j* (14*j*) according to Embodiment 1, the first louvers 513*i* (514*i*) and the second louvers 513*j* (514*j*) each include a slit 13*q* (14*q*) and a slat 13*r* (14*r*). The first louvers 513*i* (514*i*) are located in regions that are at an upstream portion of each flat heat transfer tube 513*a* (514*a*) in the direction of the airflow 5X and that are upstream of the drain holes 513*h* (514*h*) in each fin in the direction of the airflow 5X, and are arranged in the depth direction of each fin. The first louvers 513*i* (514*j*) each have an upstream end in the airflow 5X The upstream end is inclined upward. The second louvers 513*j* (514*j*) are located in regions that are at a downstream portion of each flat heat transfer tube 513*a* (514*a*) in the direction of the airflow 5X and that are downstream of the drain holes 513*h* (514*h*) in each fin in the direction of the airflow 5X, and are arranged in the depth direction of each fin. The second louvers 513*j* (514*j*) each have a downstream end in the airflow 5X. The downstream end is inclined upward.

A method for providing the above-described first louvers 513*i* (514*i*) and the above-described second louvers 513*j* (514*j*) will be described below. First, rectangular cuts are provided in each fin 513*g* (514*g*) while leaving uncut portions having the same length at both ends in the left-right direction of the fin 513*g* (514*g*). Then, both ends of the rectangular cuts are twisted by a predetermined angle. As the first louvers 513*i* (514*i*) and the second louvers 513*j* (514*j*) are obtained by providing cuts in each fin 513*g* (514*g*), openings are provided in the fin 513*g* (514*g*).

The flat heat transfer tubes 513*a* (514*a*) and the corrugated fins 513*b* (514*b*) are made from aluminum, which is highly thermally conductive. The flat heat transfer tubes 513*a* (514*a*) and the corrugated fins 513*b* (514*b*) are connected to each other by a metal joining method, such as Nocolok brazing. Although the flat heat transfer tubes 513*a* (514*a*) and the corrugated fins 513*b* (514*b*) are both made from aluminum herein, the flat heat transfer tubes 513*a* (514*a*) and the corrugated fins 513*b* (514*b*) are not necessarily made from the same material.

FIG. 18 is a graph showing the amount of water retained on the corrugated fins according to Embodiment 4 of the present invention over time. When the heat source-side heat exchanger 513 (514) according to Embodiment 4 is immersed in a water tank and lifted out, water is drained from the corrugated fins 513*b* (514*b*). More specifically, with the heat source-side heat exchanger 513 (514) of Embodiment 4, when the corrugated fins 513*b* (514*b*) are viewed in the direction of the airflow 5X, water on the end fins 513*k* (514*k*) flows toward the lower portions of the end fins 513*k* (514*k*) (in the left-right direction) and falls, and water on the first louvers 513*i* (514*i*) and the second louvers 513*j* (514*j*) falls through the openings of the first louvers 513*i* (514*i*) and the second louvers 513*j* (514*j*). In addition, water in the regions between the first louvers 513*i* (514*i*) and the second louvers 513*j* (514*j*) flows toward the lower portions of the fins 513*g* (514*g*) and falls through the drain holes 513*h* (514*h*).

The heat source-side heat exchanger 513 (514) according to Embodiment 4 and the above-described heat exchanger in the related art were immersed in a water tank and then lifted out, and water remaining on the heat source-side heat exchanger 513 (514) and water remaining on the heat exchanger in the related art were measured with a weight scale. The result of the measurement will be described with reference to FIG. 18. When the heat source-side heat exchanger 513 (514) according to Embodiment 4 is lifted out of the water tank and measurement is made over time, reduction in the amount of water retained on the heat source-side heat exchanger 513 (514) is greater than reduction in the amount of water retained on the heat exchanger in the related art. In particular, when the elapsed time is 20% of the testing time, the amount of water retained on the heat exchanger in the related art is greater than or equal to 50%. In contrast, the amount of water retained on the heat source-side heat exchanger 513 (514) according to Embodiment 4 is less than or equal to 30%. This is because the heat exchanger in the related art retains a large amount of water as the louvers of the heat exchanger in the related art are oriented horizontally to the corrugated fins, whereas the heat source-side heat exchanger 513 (514) according to Embodiment 4 is configured in such a manner that water does not remain on the corrugated fins 513*b* (514*b*) as described above and therefore have high drainage performance.

As described above, according to Embodiment 4, each corrugated fin 513*b* (514*b*) includes the fins 513*g* (514*g*) in the region between the flat heat transfer tubes 513*a* (514*a*), and each fin 513*g* (514*g*) has the drain hole 513*h* (514*h*) in the fin 513*g* (514*g*). The first louvers 513*i* (514*i*) are provided in front of the drain holes 513*h* (514*h*) in each corrugated fin 513*b* (514*b*). In addition, the second louvers 513*j* (514*j*) are provided behind the drain holes 513*h* (514*h*) in each corrugated fin 513*b* (514*b*).

The corrugated fins 513*b* (514*b*) having the above-described structure are attached between the flat heat transfer tubes 513*a* (514*a*). Consequently, drainage of water from the corrugated fins 513*b* (514*b*) during the heating operation can be improved, and the amount of residual water can be reduced. As a result, water does not easily freeze on the corrugated fins 513*b* (514*b*), and heat exchange efficiency can be increased.

Embodiment 5

Figure 19:
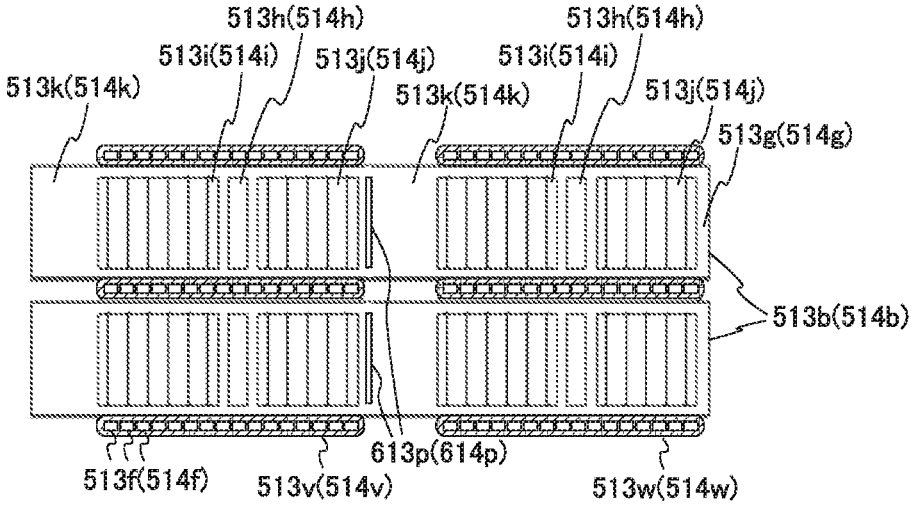
FIG. 19 is a top view of corrugated fins according to Embodiment 5 of the present invention.
Figure 20:
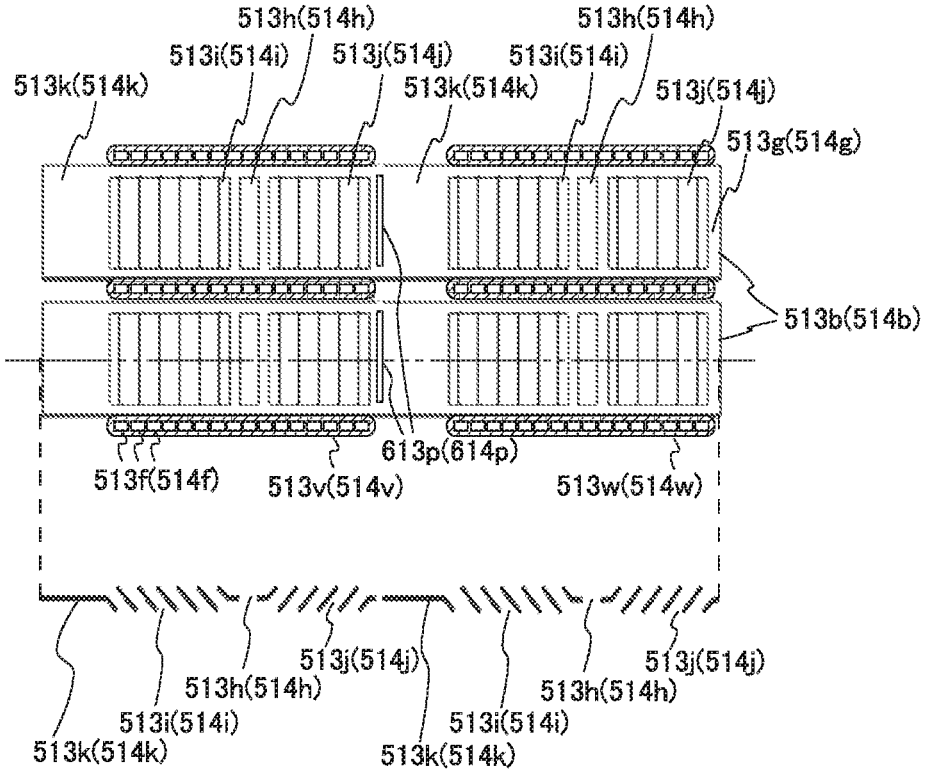
FIG. 20 shows a sectional view of the corrugated fins according to Embodiment 5 of the present invention.

FIG. 19 is a top view of corrugated fins according to Embodiment 5 of the present invention. FIG. 20 shows a sectional view of the corrugated fins according to Embodiment 5 of the present invention. Corrugated fins 513*b* (514*b*) according to Embodiment 5 are the same as the corrugated fins 513*b* (514*b*) according to Embodiment 4 except that one or more thermal resistor units that serve as thermal resistors are additionally provided. The thermal resistor units include thermal resistor slits 613*p*, which will described below, and are provided on the fins 513*g* (514*g*) at locations corresponding to regions between the flat heat transfer tubes 513*a* (514*a*) arranged in the direction of the airflow 5X. The thermal resistor units provide thermal insulation between the flat heat transfer tubes 513*a* (514*a*) in the direction of the airflow 5X, thereby reducing heat exchange between the flat heat transfer tubes. In Embodiment 5, elements that are not specifically described are similar to those in Embodiment 4, and functions, structures, and other features that are the same as those in Embodiment 4 are denoted by the same reference signs.

As illustrated in FIGS. 19 and 20, each corrugated fin 513*b* (514*b*) according to Embodiment 5 includes a plurality of first louvers 513*i* (514*i*) and a plurality of second louvers 513*j* (514*j*). The first louvers 513*i* (514*i*) are located in regions that are at an upstream portion of each flat heat transfer tube 513*a* (514*a*) in the direction of the airflow 5X and that are upstream of the drain holes 513*h* (514*h*) in each fin in the direction of the airflow 5X, and are arranged in the depth direction of each fin. The first louvers 513*i* (514*i*) each have the upstream end in the airflow 5X. The upstream end is inclined upward. The second louvers 513*j* (514*i*) are located in regions that are at a downstream portion of each flat heat transfer tube in the direction of the airflow 5X and that are downstream of the drain holes 513*h* (514*h*) in each fin in the direction of the airflow 5X, and are arranged in the depth direction of each fin. The second louvers 513*j* (514*j*) each have the downstream end in the airflow 5X. The downstream end is inclined upward. According to Embodiment 5, the thermal resistor slits 613*p*, which serve as thermal resistor units, are additionally provided between the second louvers 513*j* (514*j*) close to the first flat heat transfer tubes 513*v* and the first louvers 513*i* (514*i*) close to the second flat heat transfer tubes 513*w*. The thermal resistor slits 613*p* are each, for example, an opening that serves as a thermal resistor. The opening area of the thermal resistor slits 613*p* is less than the opening area of the drain holes 513*h* (514*h*).

A method for providing the above-described first louvers 513*i* (514*i*) and the above-described second louvers 513*j* (514*j*) will be described below. First, rectangular cuts are provided in each corrugated fin 513*b* (514*b*) while leaving uncut portions having the same length at both ends in the left-right direction of the corrugated fin 513*b* (514*b*). Then, both ends of the rectangular cuts are twisted by a predetermined angle. As the first louvers 513*i* (514*i*) and the second louvers 513*j* (514*j*) are obtained by providing cuts in each corrugated fin 513*b* (514*b*), openings are provided in the corrugated fin 513*b* (514*b*). The thermal resistor slits 613*p*, which serve as thermal resistor units, may be provided as either holes or cut-and-raised portions as long as the thermal resistor slits 613*p* serve as thermal resistors on the thermal paths between the first flat heat transfer tubes 513*v* and the second flat heat transfer tubes 513*w*.

Figure 21:
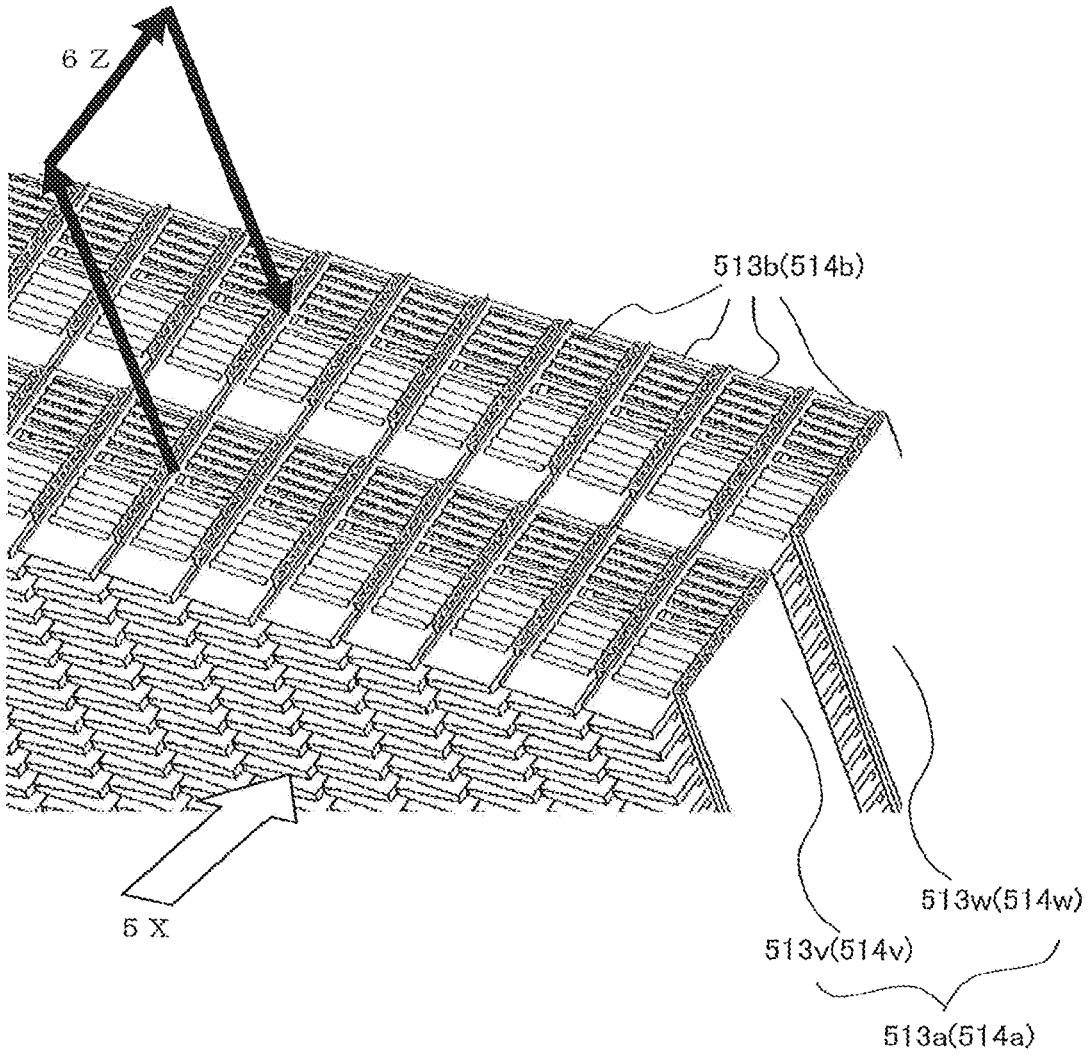
FIG. 21 illustrates a heat exchange function of a heat source-side heat exchanger 513 according to Embodiment 5 of the present invention.

FIG. 21 illustrates a heat exchange function of the heat source-side heat exchanger 513 according to Embodiment 5 of the present invention. Although the heat source-side heat exchanger 513 will be described herein, the heat source-side heat exchanger 514 has a similar function. When the heat source-side heat exchanger 513 serves as a condenser or when the heat source-side heat exchanger 513 is defrosted, air is blown in the direction of the airflow 5X, which is substantially perpendicular to the longitudinal direction of the flat heat transfer tubes 513*a* (514*a*). At this time, the refrigerant flows through the first flat heat transfer tubes 513*v*, which are upstream in the airflow 5X, in the direction from the bottom to the top. After flowing through the first flat heat transfer tubes 513*v*, the refrigerant passes through turning passages 6Z that connect the top end portions of the first flat heat transfer tubes 513*v* to the second flat heat transfer tubes 513*w* and flows into the second flat heat transfer tubes 513*w*. The refrigerant then flows through the second flat heat transfer tubes 513*w* in the direction from the top to the bottom of the heat source-side heat exchanger 513.

Figure 22:
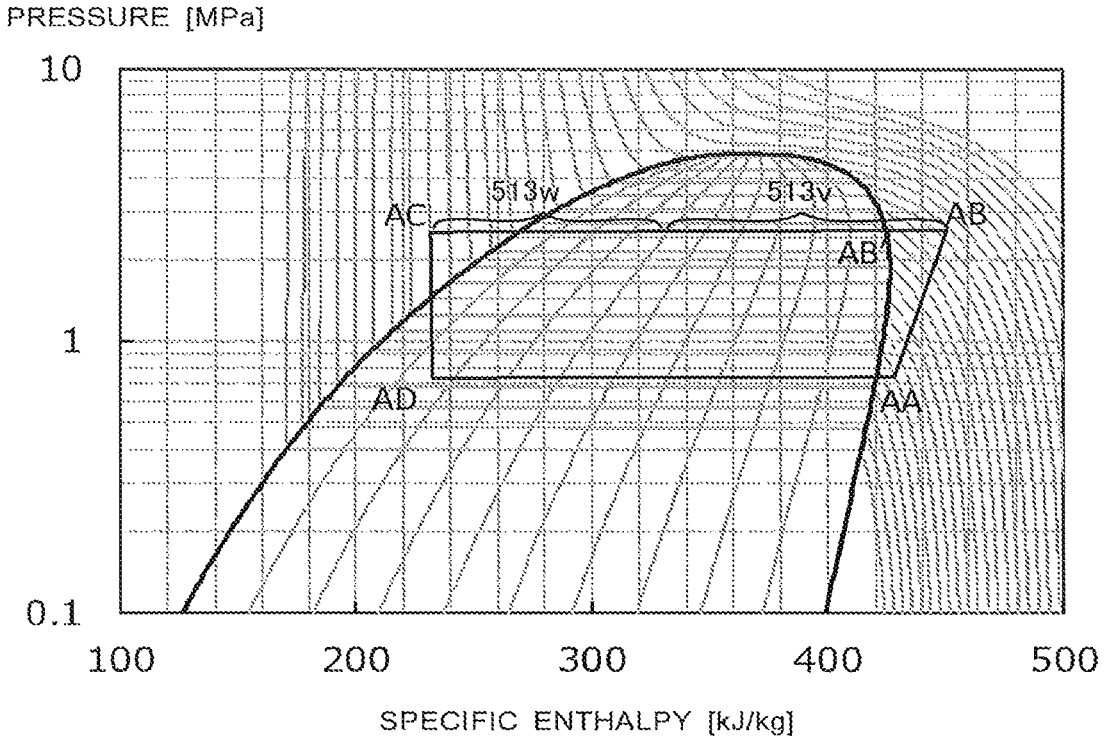
FIG. 22 illustrates the state of refrigerant that flows through an air-conditioning apparatus according to Embodiment 5 of the present invention.

FIG. 22 illustrates the state of the refrigerant that flows through an air-conditioning apparatus according to Embodiment 5 of the present invention. The high-temperature high-pressure gas refrigerant discharged from the compressor 511 flows into the first flat heat transfer tubes 513*v* of the heat source-side heat exchanger 513 from the bottom. As the refrigerant flows upward through the first flat heat transfer tubes 513*v*, sensible heat exchange occurs and the temperature drops (AB to AB' in FIG. 20). Subsequently, condensation starts (AB' to AC in FIG. 20). The refrigerant is condensed as the refrigerant flows from the first flat heat transfer tubes 513*v* to the second flat heat transfer tubes 513*w*, and the ratio of the refrigerant in liquid form increases. Finally, the refrigerant in a liquid single-phase state at point AC flows out of the second flat heat transfer tubes 513*w*.

The temperature of the first flat heat transfer tubes 513*v* increases as the high-temperature gas refrigerant flows through the first flat heat transfer tubes 513*v*. The temperature of the second flat heat transfer tubes 513*w* becomes equal to that of the two-phase refrigerant. Consequently, the temperature of the first flat heat transfer tubes 513*v* becomes higher than that of the second flat heat transfer tubes 513*w*, and a temperature difference is generated. As a result, the refrigerant in the first flat heat transfer tubes 513*v* and the refrigerant in the second flat heat transfer tubes 513*w* exchange heat with each other and cannot exchange heat with the air in the airflow 5X. Thus, the heat exchanger does not serve appropriately.

The corrugated fins 513*b* included in the heat source-side heat exchanger 513 according to Embodiment 5 have the thermal resistor slits 613*p*, which serve as thermal resistors, in the regions between the first flat heat transfer tubes 513*v* and the second flat heat transfer tubes 513*w*. Consequently, the heat exchange between the refrigerant and the refrigerant can be prevented and the performance of the heat exchanger can be improved.

According to Embodiment 5, the first flat heat transfer tubes 513*v* is disposed upstream of the airflow 5X and the second flat heat transfer tubes 513*w* is disposed downstream of the airflow 5X, and the refrigerant flows from below. However, a similar effect can be obtained irrespective of the direction in which refrigerant flows as long as refrigerant flows through a heat transfer tube at different temperature from that of refrigerant flowing through another heat transfer tube.

REFERENCE SIGNS LIST

10, 510 heat source-side unit 10*a*, 510*a* housing 11, 511 compressor 12, 512 flow switching device 13, 14, 513, 514 heat source-side heat exchanger 13*a*, 14*a*, 513*a*, 514*a* flat heat transfer tube 13*b*, 14*b*, 513*b*, 514*b* corrugated fin 13*c*,

14*c*, 513*c*, 514*c* upper header 13*d*, 14*d*, 513*d*, 514*d* lower header 13*e*, 14*e*, 513*e*, 514*e* flat surface 13*f*, 14*f*, 513*f*, 514*f* refrigerant passage 13*g*, 14*g*, 513*g*, 514*g* fin 13*h*, 14*h*, 513*h*, 514*h* drain hole 13*i*, 14*i*, 513*i*, 514*i* first louver 13*j*, 14*j*, 513*j*, 514*j* second louver 13*k*, 14*k*, 513*k*, 514*k* end fin 13*m*, 14*m* water guiding projection 13*q*, 14*q* slit 13*r*, 14*r* slat 513*v*, 514*v* first flat heat transfer tube 513*w*, 514*w* second flat heat transfer tube 15, 515 accumulator 16, 516 fan 20, 30, 520, 530 use-side unit 20*a*, 30*a*, 520*a*, 530*a* use-side heat exchanger 20*b*, 30*b*, 520*b*, 530*b* expansion device 100, 5100 air-conditioning apparatus 613*p* thermal resistor slit X, 5X, Y airflow 6Z turning passage

The invention claimed is:

1. A heat exchanger, comprising:

a plurality of flat heat transfer tubes each having a flat shape in cross section, the plurality of flat heat transfer tubes being arranged with gaps between flat surfaces of the plurality of flat heat transfer tubes facing each other, the plurality of flat heat transfer tubes each having a flow passage extending through a corresponding one of the plurality of flat heat transfer tubes in a vertical direction; and a plurality of corrugated fins each bent in a zigzag shape in the vertical direction and disposed between the flat surfaces facing each other, the plurality of corrugated fins each having an end portion at an upstream end in a first direction in which air flows to pass through the plurality of corrugated fins, the end portion protruding from end portions of the flat surfaces of the plurality of flat heat transfer tubes, a drain hole provided adjacent to central regions of the flat surfaces of the plurality of flat heat transfer tubes in the first direction, a plurality of first louvers located upstream of the drain hole in the first direction, the plurality of first louvers each including a slit and a slat that is inclined in the vertical direction and that causes the air to flow through the slit, and a plurality of second louvers located downstream of the drain hole in the first direction, the plurality of second louvers each including a slit and a slat that is inclined in the vertical direction and that causes the air to flow through the slit, a width of the drain hole in the first direction in which the air flows being greater than or equal to one-half of a maximum interval of the zigzag shape in the vertical direction, a length of the drain hole in a second direction in which the plurality of flat heat transfer tubes are arranged being greater than or equal to one-half of a length of each of the plurality of corrugated fins in the second direction in which the plurality of flat heat transfer tubes are arranged, the second direction being orthogonal to the first direction, the drain hole being shaped in such a manner that a width of the drain hole gradually decreases from both ends toward a center in the second direction.

2. The heat exchanger of claim 1, wherein the plurality of corrugated fins each further include water guiding projections on the end portion of a corresponding one of the plurality of corrugated fins, the water guiding projections being each inclined toward a corresponding one of the plurality of flat heat transfer tubes in such a manner that a gap between the water guiding projections increases from upstream ends to downstream ends of the water guiding projections in the first direction.

3. The heat exchanger of claim 1, wherein the slats of each of the plurality of first louvers each have an upstream end in the first direction, the upstream end being inclined upward, and the slats of each of the plurality of second louvers each have a downstream end in the first direction, the downstream end being inclined upward.

4. The heat exchanger of claim 1, further comprising an additional plurality of flat heat transfer tubes arranged in the first direction, wherein the plurality of corrugated fins each include the drain hole, the plurality of first louvers, and the plurality of second louvers that are each adjacent to a corresponding portion of the additional plurality of flat heat transfer tubes.

5. The heat exchanger of claim 4, wherein the plurality of corrugated fins each further include a thermal resistor unit provided to a region between the plurality of flat heat transfer tubes and the additional plurality of flat head transfer tubes, the thermal resistor unit providing thermal insulation between the plurality of flat heat transfer tubes and the additional plurality of flat head transfer tubes.

6. The heat exchanger of claim 5, wherein the thermal resistor unit has a hole that extends through each of the plurality of corrugated fins, the hole of the thermal resistor unit having an opening area less than an opening area of the drain hole.

7. An air-conditioning apparatus, comprising:

a heat source-side unit including a compressor, a flow switching device, and a heat source-side heat exchanger; and a use-side unit including a use-side heat exchanger, wherein the air-conditioning apparatus is configured to circulate refrigerant in such a manner that the refrigerant compressed by the compressor flows into the heat source-side heat exchanger or the use-side heat exchanger depending on a switching state of the flow switching device, and wherein the heat source-side heat exchanger comprises the heat exchanger of claim 1.

8. The air-conditioning apparatus of claim 7, wherein the flow switching device is configured to switch in such a manner that when the refrigerant that passes through the heat source-side heat exchanger is to be evaporated, the refrigerant flows through the heat source-side heat exchanger to cause heat exchange between upstream portion of the refrigerant in a direction in which the refrigerant flows and downstream portion of air in a direction in which the air flows to pass through the heat source-side heat exchanger and heat exchange between downstream portion of the refrigerant in the direction in which the refrigerant flows and upstream portion of the air in the direction in which the air flows, and when the refrigerant that passes through the heat source-side heat exchanger is to be condensed or when the heat source-side heat exchanger is to be defrosted, the refrigerant flows through the heat source-side heat exchanger to cause heat exchange between upstream portion of the refrigerant in the direction in which the refrigerant flows and upstream portion of the air in the direction in which the air flows and heat exchange between downstream portion of the refrigerant in the direction in which the refrigerant flows and downstream portion of the air in the direction in which the air flows.

* * * * *